US005242274A

United States Patent [19]

Inoue

[11] Patent Number: 5,242,274

[45] Date of Patent: Sep. 7, 1993

[54] SLANT PLATE TYPE COMPRESSOR WITH VARIABLE DISPLACEMENT MECHANISM

[75] Inventor: Atsuo Inoue, Sawa, Japan

[73] Assignee: Sanden Corporation, Gunma, Japan

[21] Appl. No.: 826,854

[22] Filed: Jan. 28, 1992

[30] Foreign Application Priority Data

Jan. 28, 1991 [JP] Japan ..... 3-025073
Feb. 8, 1991 [JP] Japan ..... 3-037852

[51] Int. Cl.[5] ..... F04B 1/26
[52] U.S. Cl. ..... 417/222.2; 417/270
[58] Field of Search ..... 417/222 S, 222 R, 270, 417/222.1, 222.2

[56] References Cited

U.S. PATENT DOCUMENTS 4,606,705 8/1986 Parekh ..... 417/222 S

FOREIGN PATENT DOCUMENTS 0259760 3/1988 European Pat. Off. .
3713696 10/1987 Fed. Rep. of Germany .
3824752 1/1990 Fed. Rep. of Germany .
4019027 12/1990 Fed. Rep. of Germany .
247186 10/1987 Japan ..... 417/222 S
49976 2/1990 Japan ..... 417/222 S

*Primary Examiner*—Richard A. Bertsch
*Assistant Examiner*—Peter Korytnyk
*Attorney, Agent, or Firm*—Baker & Botts

[57] ABSTRACT

A variable capacity type slant plate compressor including a crank chamber a suction chamber and a discharge chamber is disclosed. The crank chamber is linked by a first communication path to the suction chamber, and is linked by a second communication path to the discharge chamber. A first valve control mechanism is disposed within the first communication path. A second valve control mechanism is disposed within the second communication path. The first valve control mechanism controls the opening and closing of the first communication path so that the suction chamber pressure is maintained at a predetermined constant value. The second communication path is compulsorily opened by operation of the second valve control mechanism in response to an external signal so as to compulsorily minimize the capacity of the compressor. A throttling device is disposed within the second communication path between the discharge chamber and the second valve control mechanism so that the capacity of the compressor is compulsorily quickly minimized without damage of the internal component parts of the compressor.

10 Claims, 6 Drawing Sheets

SLANT PLATE TYPE COMPRESSOR WITH VARIABLE DISPLACEMENT MECHANISM

BACKGROUND OF THE INVENTION

1. Field Of The Invention

The present invention generally relates to a refrigerant compressor and, more particularly, to a slant plate type compressor, such as a wobble plate type compressor, with a variable displacement mechanism suitable for use in an automotive air conditioning system.

2. Description Of The Prior Art

A wobble plate type compressor with a variable displacement mechanism suitable for use in an automotive air conditioning system is disclosed in Japanese Utility Model Application Publication No. 64-27487. The compressor is driven by the engine of the automobile.

The compressor includes a variable displacement mechanism which comprises a first communication path linking a crank chamber and a suction chamber in fluid communication, and a second communication path linking the crank chamber and a discharge chamber. A first valve control mechanism controlling the opening and closing of the first communication path is disposed within the first communication path. A second valve control mechanism controlling the opening and closing of the second communication path is disposed within the second communication path. The first communication path is provided with a first valve seat formed at one portion thereof. The second communication path is provided with a second valve seat formed at one portion thereof. The first valve control mechanism includes a first valve member which is disposed so as to be received on and moved away from the first valve seat. The second valve control mechanism includes a second valve member which is disposed so as to be received on and moved away from the second valve seat.

The first and second valve members are linked through a rod member so that when the first valve member is received on the first valve seat to close the first communication path, the second valve member is moved away from the second valve seat to open the second communication path. Conversely, when the first valve member is moved away from the first valve seat, the second valve member is received on the second valve seat.

In operation of the compressor, the capacity of the compressor depends upon the crank chamber pressure relative to the suction chamber pressure, with the compressor operating at maximum capacity when the crank and suction chambers are linked in fluid communication. When the link between the crank and suction chambers is terminated, simultaneously linking the crank and discharge chambers, the pressure in the crank chamber increases relative to the suction chamber due to the flow of high pressure fluid from the discharge chamber to the crank chamber, reducing capacity. Of course, when operating at reduced capacity, the power demands of the compressor on the engine are reduced as well.

The first valve control mechanism includes a pressure sensing device such as a diaphragm for sensing on one side the pressure in the suction chamber. The opposite side of the diaphragm is acted upon by a cylindrical member made of magnetic material and forming part of a solenoid mechanism. The relative position of the cylindrical member and thus the effective force provided thereby upon the diaphragm is controlled by the solenoid in response to an external vehicle condition, such as the power demands made upon the engine to drive the vehicle.

The diaphragm is responsive to the net force acting on the opposite sides thereof and acts upon the rod member linking the first and second valve members to simultaneously control the opening and closing of the two communication paths. For a given positioning of the cylindrical member the effect thereof on the diaphragm is constant, and the diaphragm responds to changes in the suction pressure to act upon the rod member to control the link between the crank and suction chambers. Thus, for a given positioning of the cylindrical member, the first valve member acts to maintain the suction pressure at a predetermined constant value. By changing the position of the cylindrical member through functioning of the solenoid in response to the demands made upon the engine for driving the vehicle, the predetermined constant value of the suction pressure can be changed in response to the demands made upon the engine.

As discussed above, the compressor operates at maximum capacity when the crank and suction chambers are linked. This linkage occurs when the suction pressure exceeds the predetermined constant value and acts upon the diaphragm to move the first valve member away from the first valve seat, simultaneously isolating the crank and discharge chambers. For example, when the heat load on the evaporator is great, the suction pressure will be great, causing the crank and suction chambers to be linked, maximizing capacity.

However, when the power demand for the vehicle is great, it is not desirable for the compressor to operate at maximum capacity, even if the heat load on the evaporator and the corresponding suction pressure are large. The solenoid acts in response to the greater demand for power made on the engine by the vehicle, to increase the effect of the cylindrical member upon the diaphragm, for example, by reducing the force with which the cylindrical member is pulled away from the diaphragm. Thus, the predetermined constant value at which the suction pressure is maintained will be increased, requiring an even greater pressure in the suction chamber before the crank and suction chambers will be linked.

Therefore, even if the suction pressure is increased, for example, due to an increase of the heat load on the evaporator, the compressor will not function at maximum capacity while the demand for engine power by the vehicle is large, since the crank and suction chambers will be isolated. Correspondingly, the crank and discharge chambers will be linked, rapidly increasing the crank pressure relative to the suction pressure to minimize compressor capacity. Accordingly, the energy derived from the engine of the vehicle is effectively used for driving the vehicle.

When the first valve member is received on the first valve seat so as to close the first communication path while the second valve member is moved away from the second valve seat so as to open the second communication path, the refrigerant gas at discharge pressure flows to the crank chamber, increasing the pressure therein, and quickly reducing capacity, as discussed above. The quantity of refrigerant gas which flows from the discharge chamber to the crank chamber is substantially determined by the size of the open area of the second valve seat. However, in the manufacturing process of the compressor, it is difficult to manufacture the second valve seat so as to have a certain size which allows for the controlled flow of a predetermined, known volume of the refrigerant gas from the discharge chamber to the crank chamber.

Since the volume of flow cannot be effectively controlled, when the displacement of the compressor is minimized, if the size of the open area of the second valve seat is selected to be too large, the quantity of the refrigerant gas which flows from the discharge chamber to the crank chamber is large, causing the pressure in the crank chamber to be quickly increased to thereby quickly reduce the displacement of the compressor. However, the pressure in the crank chamber may be increased to an excessively high value and maintained at that value until the crank and suction chambers are again linked, resulting in damage to the internal component parts of the compressor.

On the other hand, if the size of the open area of the second valve seat is selected to be small, the quantity of the refrigerant gas which flows from the discharge chamber to the crank chamber is small, causing the pressure in the crank chamber to be too slowly increased. Thus, even though the crank chamber pressure will not exceed and be maintained at a value which causes damage to the internal components of the compressor, the displacement of the compressor will not be reduced quickly enough to obtain an effective reduction of the power demand on the engine by the compressor during times when a large amount of engine power is required to drive the vehicle.

Further, in both of the above cases, the effectiveness of displacement control is limited by the fact that the first and second valve control mechanisms are not controlled independently. When the suction and crank chambers are isolated, the discharge and crank chambers are linked, increasing the crank chamber pressure. However, if it is desired that the crank and discharge chambers be isolated to limit the build-up of pressure in the crank chamber, the crank and suction chambers must be linked. This linkage may occur when the demand for engine power to drive the vehicle is still large. Thus, before it is desired to do so, the compressor may be restored to maximum displacement.

SUMMARY OF THE INVENTION

Accordingly, it is an object of the present invention to provide a variable capacity slant plate type compressor in which the capacity of the compressor can be compulsorily quickly minimized without causing damage to the internal component parts of the compressor.

A compressor according to the invention includes a compressor housing enclosing a crank chamber, a suction chamber and a discharge chamber therein. The compressor housing include a cylinder block having a plurality of cylinders. A piston is slidably fitted within each of the cylinders. A driving mechanism is coupled to the pistons for reciprocating the pistons within the cylinders. The driving mechanism includes a drive shaft rotatably supported in the housing.

A coupling device couples the pistons with the drive shaft for converting rotary motion of the drive shaft into reciprocating motion of the pistons. The coupling device includes a slant plate having a surface disposed at a slant angle relative to a plane perpendicular to the drive shaft. The slant angle changes in response to a change in pressure in the crank chamber to change the capacity of the compressor.

A first communication path links the crank chamber with the suction chamber. A first valve control mechanism is disposed within the first communication path. The first valve control mechanism controls the opening and closing of the first communication path in response to the changes in pressure in the suction chamber to maintain a constant pressure in the suction chamber. A second communication path links the crank chamber with the discharge chamber. A second valve control mechanism is disposed within the second communication path. The second valve control mechanism responds to an external signal and opens the second communication path to increase the pressure in the crank chamber to thereby minimize the capacity of the compressor.

A throttling device is disposed within the second communication path between the discharge chamber and the second valve control mechanism so as to regulate the quantity of fluid which flows from the discharge chamber to the crank chamber when the second valve control mechanism opens the second communication path.

DETAILED DESCRIPTION OF THE PREFERRED EMBODIMENTS

Figure 1:
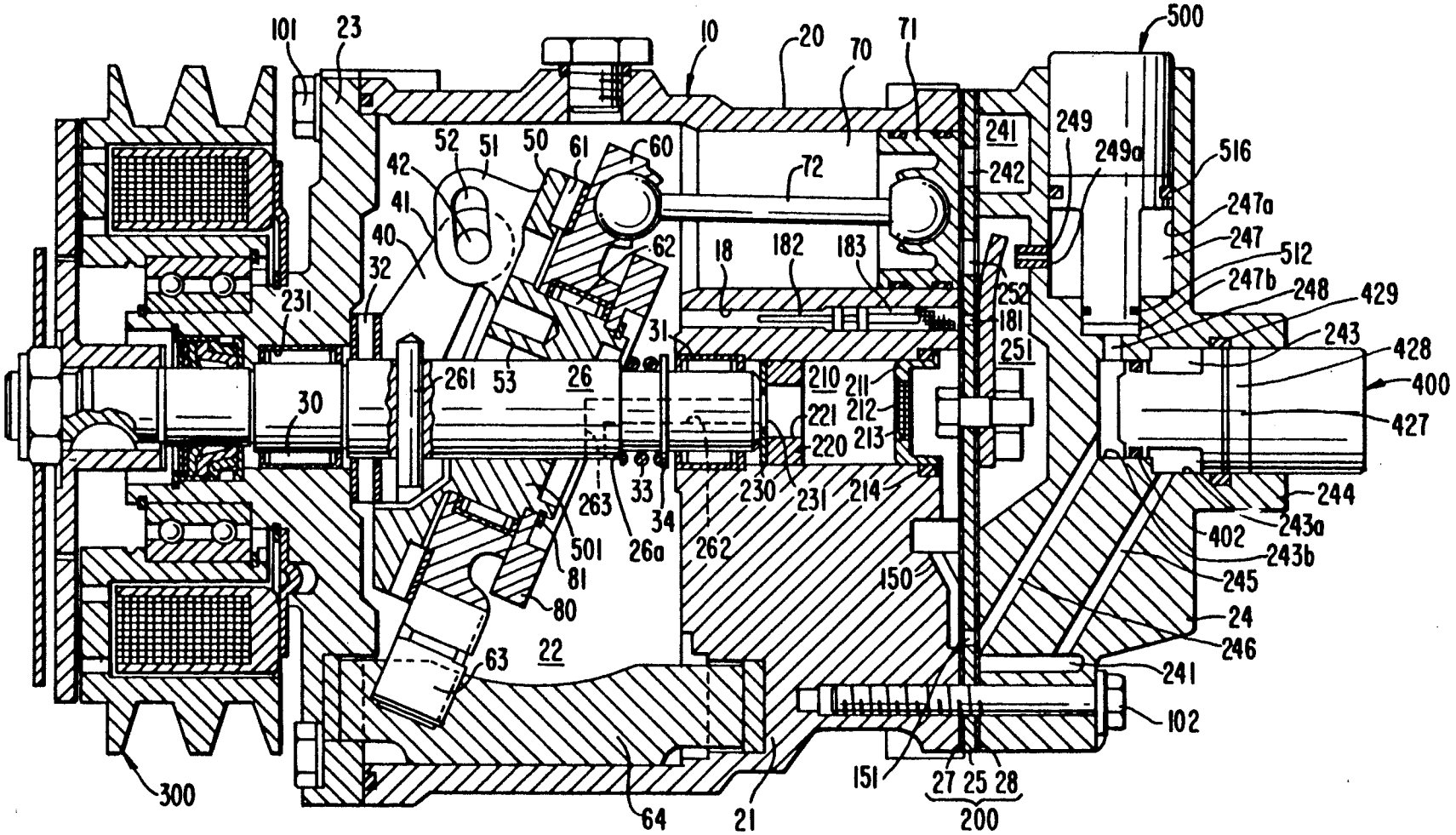
FIG. 1 is a longitudinal sectional view of a slant plate type compressor in accordance with a first embodiment of the present invention.

In FIGS. 1–6, identical reference numerals are used to denote identical elements. Additionally, although the present invention is described below in terms of a wobble plate type compressor, it is not limited in this respect. The present invention is broadly applicable to slant plate type compressors. Furthermore, for purposes of explanation only, the left side of FIGS. 1–6 will be referenced as the forward end or front and the right side of the drawings will be referenced as the rearward end. The term axial, refers to a direction parallel to the longitudinal axis of the drive shaft, and the term "radial" refers to the perpendicular direction. The terms "upwardly" and "downwardly" are also made with reference to the figures. Of course, all of the reference directions are made for the sake of convenience of description and are not intended to limit the invention in any way.

FIG. 1 illustrates the overall construction of a wobble plate type refrigerant compressor with a variable displacement mechanism in accordance with a first embodiment of the present invention. Compressor 10 includes cylindrical housing assembly 20 including cylinder block 21, front end plate 23 disposed at one end of cylinder block 21, crank changer 22 enclosed within cylinder block 21 by front end plate 23, and rear end plate 24 attached to the other end of cylinder block 21. Front end plate 23 is secured to one end of cylinder block 21 by a plurality of bolts 101. Rear end plate 24 is secured to the opposite end of cylinder block 21 by a plurality of bolts 102. Valve plate 25 is disposed between rear end plate 24 and cylinder block 21. Opening 231 is centrally formed in front end plate 23 for supporting drive shaft 26 by bearing 30 disposed therein. The inner end portion of drive shaft 26 is rotatably supported by cylinder block 21 through bearing 31.

Bore 210 extends to a rear end surface of cylinder block 21 and includes a threaded portion (not shown) formed at an inner peripheral surface of a central region thereof. Adjusting screw 220 having a hexagonal central hole 221 is screwed into the threaded portion of bore 210. Circular disc-shaped spacer 230 having central hole 231 is disposed between the inner end of drive shaft 26 and adjusting screw 220. Axial movement of adjusting screw 220 is transferred to drive shaft 26 through spacer 230 so that all three elements may be move axially within bore 210. The construction and functional manner of adjusting screw 220 and spacer 230 are described in detail in U.S. Pat. No. 4,948,343 to Shimizu, incorporated by reference.

Cup-shaped member 211 is fixedly disposed at a rear portion of bore 210. Filter member 212 is fixedly disposed in hole 213 which is centrally formed at a bottom end of cup-shaped member 211. Axial bore 262 is formed through drive shaft 26. One end of axial bore 262 opens to central hole 231 of spacer 230, and the other end of axial bore 262 is located at a position which is forward of cylinder block 21. Radial hole 263 is formed through drive shaft 26 so as to link the other end of axial bore 262 to crank chamber 22. O-ring seal element 214 is disposed between the outer peripheral surface of the rear end portion of cup-shaped member 211 and the inner peripheral surface of the rear portion of bore 210.

Cam rotor 40 is fixed on drive shaft 26 by pin member 261 and rotates therewith. Thrust needle bearing 32 is disposed between the inner end surface of front end plate 23 and the adjacent axial end surface of cam rotor 40. Cam rotor 40 includes arm 41 having pin member 42 extending therefrom. Slant plate 50 is disposed adjacent cam rotor 40 and includes opening 53 through which drive shaft 26 passes. Slant plate 50 includes arm 51 having slot 52. Cam rotor 40 and slant plate 50 are coupled by pin member 42 which is inserted in slot 52 to form a hinged joint. Pin member 42 slides within slot 52 to allow adjustment of the slant angle of slant plate 50, that is, the angle of the surface of slant plate 50 with respect to a plane perpendicular to the longitudinal axis of drive shaft 26.

Wobble plate 60 is mounted on slant plate 50 through bearings 61 and 62 such that slant plate 50 may rotate with respect thereto. Balance weight ring 80 of substantial mass is disposed on a nose of hub 501 of slant plate 50 in order to balance the slant plate 50 under dynamic operating conditions. Balance weight ring 80 is held in place by means of retaining ring 81. Bias spring 33 is compressedly mounted on drive shaft 26 at a portion between annular ridge **26*a* and snap ring 34. Fork shaped slider 63 is attached to the outer peripheral end of wobble plate 60 and is slidably mounted on sliding rail 64 disposed between front end plate 23 and cylinder block 21. Fork shaped slider 63 prevents rotation of wobble plate 60. Wobble plate 60 nutates along rail 64 when cam rotor 40 and slant plate 50 rotate. Cylinder block 21 includes a plurality of peripherally located cylinder chambers 70 in which pistons 71 reciprocate. Each piston 71 is coupled to wobble plate 60 by a corresponding connecting rod 72**.

Rear end plate 24 includes peripherally positioned annular suction chamber 241 and centrally positioned discharge chamber 251. Valve plate 25 is located between cylinder block 21 and rear end plate 24 and includes a plurality of valved suction ports 242 linking suction chamber 241 with respective cylinders 70. Valve plate 25 also includes a plurality of valved discharge ports 252 linking discharge chamber 251 with respective cylinders 70. Suction ports 242 and discharge ports 252 are provided with suitable reed valves as described in U.S. Pat. No. 4,011,029 to Shimizu, incorporated by reference.

Suction chamber 241 includes an inlet portion (not shown) which is connected to an evaporator of an external cooling circuit (not shown). Discharge chamber 251 is provided with an outlet portion (not shown) connected to a condenser of the cooling circuit (not shown).

Gaskets 27 and 28 are positioned between cylinder block 21 and the inner surface of valve plate 25 and the outer surface of valve plate 25 and rear end plate 24, respectively. Gaskets 27 and 28 seal the mating surface of cylinder block 21, valve plate 25 and rear end plate 24. Gaskets 27 and 28 and valve plate 25 thus form valve plate assembly 200. Passage 150 is formed at the rear end of cylinder block 21. One end of passage 150 is open to the rear end portion of bore 210 and the other end of passage 150 is open to hole 151 which is bored through valve plate assembly 200.

Conduit 18 is axially bored through cylinder block 21 so as to link crank chamber 22 to discharge chamber 251 through hole 181 which is axially bored through valve plate assembly 200. A throttling device, such as, orifice tube 182 is fixedly disposed within conduit 18. Filter member 183 is disposed in conduit 18 at the rear of orifice tube 182. Accordingly, a portion of the discharged refrigerant gas in discharge chamber 251 always flows into crank chamber 22 with a reduced pressure generated by orifice tube 182. The above-mentioned construction and functional manner are described in detail in Japanese Patent Application Publication No. 1-142,277.

Axially extending first cylindrical cavity 243 is formed in a central portion of rear end plate 24 to the rear of discharge chamber 251. First cylindrical cavity 243 includes large diameter portion **243*a* and small diameter portion 243*b* extending forwardly from large diameter portion 243*a*. Annular projection 244 projects from a central region of the rear end surface of rear end plate 24 and defines the rear portion of first cylindrical cavity 243. First valve control mechanism 400 is fixedly disposed in first cylindrical cavity 243**.

Radially extending second cylindrical cavity 247 is formed in rear end plate 24 to the rear of suction chamber 241 and a part of discharge chamber 251. Second cylindrical cavity 247 includes large diameter portion **247*a* and small diameter portion 247*b* extending downwardly from a radial inner end of large diameter portion 247*a*. Second valve control mechanism 500 is fixedly disposed in second cylindrical cavity 247**.

Figure 2:
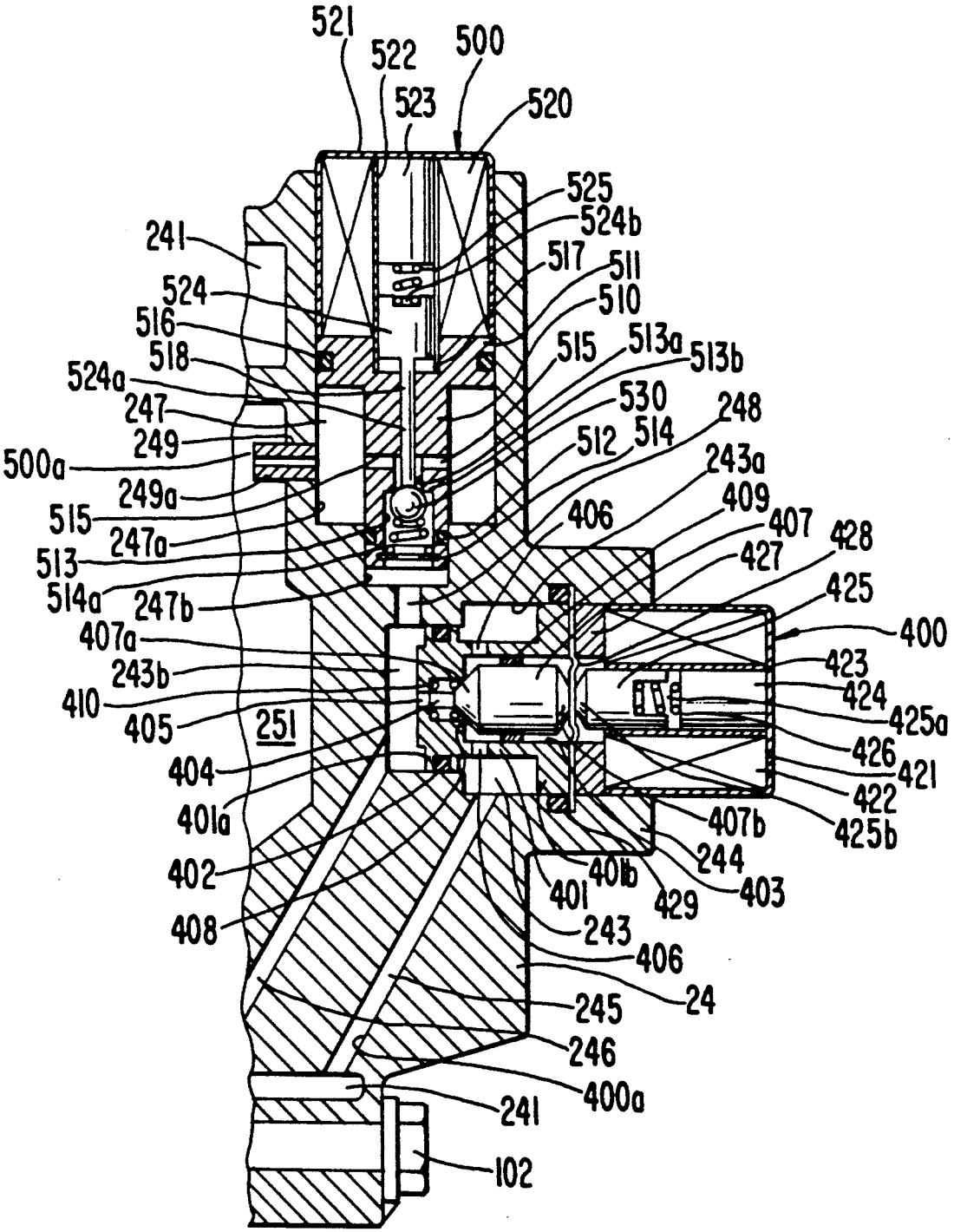
FIG. 2 is an enlarged fragmentary longitudinal sectional view of a valve control mechanism shown in FIG. 1.

With further reference to FIG. 2, the construction and functioning of first and second valve control mechanisms 400 and 500 is described in detail. First valve control mechanism 400 includes cylindrical member 401 which comprises front annular flange 401*a* outwardly extending from a front end thereof and rear annular flange 401*b* outwardly extending from a rear end thereof. Front annular flange 401*a* is positioned within the rear half of small diameter portion 243*b* of first cylindrical cavity 243. Rear annular flange 401*b* is positioned within the mid region of large diameter portion 243*a* of first cylindrical cavity 243. O-ring seal element 402 is disposed about an outer peripheral surface of front annular flange 401*a* to seal the mating surfaces between the inner peripheral surface of small diameter portion 243*b* of first cylindrical cavity 243 and the outer peripheral surface of front annular flange 401*a*. O-ring seal element 402 sealingly insulates a front hollow space of small diameter portion 243*b* of cavity 243 from a front hollow space of large diameter portion 243*a* of cavity 243.

Axially extending cylindrical cavity 403 is formed in cylindrical member 401. Cylindrical cavity 403 extends forwardly from the rear end surface of cylindrical member 401 and terminates at a position which is at the rear of front annular flange 401*a*. Axially extending cylindrical cavity 404 having a diameter which is smaller than the diameter of cylindrical cavity 403 extends through cylinder member 401 from the front end of cylindrical cavity 403 and terminates at a position which is adjacent to the front end of cylindrical member 401. Annular ridge 408 functions as a first valve seat and is formed at the boundary between cylindrical cavities 403 and 404. Axial hole 405 is centrally formed at the front end portion of cylindrical member 401 so as to link cylindrical cavity 404 to the front hollow space of small diameter portion 243*b* of cylindrical cavity 243. A plurality of radial holes 406 are formed at the side portion of cylindrical member 401 so as to link the front hollow space of large diameter portion 243*a* of cavity 243 to cylindrical cavity 403.

Cylindrical valve member 407 is axially movably disposed in cylindrical cavity 403. Cylindrical valve member 407 includes truncated cone shaped portion 407*a* formed at the front end thereof and spherically shaped convex portion 407*b* formed at the rear end thereof. Truncated cone shaped portion 407*a* of cylindrical valve member 407 is received by first valve seat 408 when cylindrical valve member 407 moves forwardly. Annular ring member 409 is fixedly disposed about the outer peripheral surface at a mid region of cylindrical valve member 407 so as to guide cylindrical valve member 407 along an inner peripheral surface of cylindrical cavity 403 when cylindrical valve member 407 axially moves in cylindrical cavity 403. Coil spring 410 is resiliently disposed between the front surface of cylindrical cavity 404 and the flat front end surface of truncated cone shaped portion 407*a* of cylindrical valve member 407 so that cylindrical valve member 407 is urged rearwardly by the restoring force of coil spring 410.

First valve control mechanism 400 further includes cupshaped casing 421 disposed within annular projection 244 and which houses annular electromagnetic coil 422, annular cylindrical member 423 forcibly inserted within annular electromagnetic coil 422, cylindrical pedestal 424 of magnetic material fixedly disposed within a rear portion of annular cylindrical member 423, and cylindrical member 425 of magnetic material axially slidably disposed within a front portion of annular cylindrical member 423. Cylindrical member 425 includes cylindrical hollow space 425*a* formed at a rear end surface thereof and spherically shaped convex portion 425*b* formed at the front end thereof. Coil spring 426 is resiliently disposed between the front end surface of pedestal 424 and the front bottom surface of cylindrical hollow space 425*a* of cylindrical member 425 so that cylindrical member 425 is urged forwardly by the restoring force of coil spring 426.

Annular plate member 427 is disposed at a front open end of cup-shaped casing 421. Annular plate member 427 and a front portion of cup-shaped casing 421 are fixedly disposed in large diameter portion 243*a* of first cylindrical cavity 243 by forcible insertion. Diaphragm 428 is disposed between the rear annular flange 401*b* of cylindrical member 401 and annular plate member 427. An outer periphery of diaphragm 428 is fixedly sandwiched by rear annular flange 401*b* and annular plate member 427. O-ring seal element 429 is disposed in a circular groove formed at the inner peripheral surface of a mid region of large diameter portion 243*a* of cavity 243 so as to seal the mating surfaces between the inner peripheral surface of large diameter portion 243*a* of cavity 243 and the outer peripheral surface of rear annular flange 401*b* of cylindrical member 401. O-ring seal element 429 sealingly insulates the front hollow space of large diameter portion 243*a* of cavity 243 from the atmosphere outside of compressor 10.

Second valve control mechanism 500 includes cylindrical member 510 and annular electromagnetic coil 520 which is located at a radially outer side of cylindrical member 510, that is, above cylindrical member 510. Cylindrical member 510 comprises annular flange 511 outwardly extending at the radially outer end thereof. Annular flange 511 is located at a mid region of second cylindrical cavity 247. The radial inner end region of cylindrical member 510 is fixedly inserted within small diameter portion 247*b* of second cylindrical cavity 247 at a position which is approximately two-thirds from the top thereof.

O-ring seal element 512 is disposed at an outer peripheral surface of the radial inner end region of cylindrical member 510 to seal the mating surfaces between the outer peripheral surface of cylindrical member 510 and the inner peripheral surface of small diameter portion 247*b* of cavity 247. O-ring seal element 512 sealingly insulates a radial inner hollow space of large diameter portion 247*a* of cavity 247 from a radial inner hollow space of small diameter portion 247*b* of cavity 247.

Radially extending circular hole 513 is formed in cylindrical member 510. Circular hole 513 extends upwardly from the radial inner end of cylindrical member 510 and terminates at a position which is approximately one-third from the bottom of cylindrical member 510. Circular hole 513*a* having a diameter which is smaller than the diameter of circular hole 513 extends from the upper end of circular hole 513 and terminates at a position which is approximately one half of the length of cylindrical member 510. The diameter of circular hole 513*a* is much greater than the diameter of rod 524*a* disposed therein (and discussed further below) so as to allow a large amount of refrigerant gas to flow through circular hole 513*a*. Annular ridge 513*b* functions as a second valve seat and is formed at the boundary between circular holes 513 and 513*a*.

Snap ring 514 is fixedly disposed at an inner peripheral surface of the radial inner end region of cylindrical member 510. Coil spring 514*a* is disposed upon snap ring 514, and resiliently supports ball valve member 530 which is radially movably disposed in hole 513. Ball valve member 530 is received on second valve seat 513b when ball valve member 530 moves upwardly. A plurality of holes 515 are formed through a side portion of cylindrical member 510 so as to link in fluid communication the inner hollow space defined by circular hole 513 to the radial inner hollow space defined by large diameter portion 247a of cavity 247, when ball valve 530 is moved downwardly away from valve seat 513b.

O-ring seal element 516 is disposed at an outer peripheral surface of annular flange 511 of cylindrical member 510 to seal the mating surfaces between the outer peripheral surface of annular flange 511 and the inner peripheral surface of large diameter portion 247a of cavity 247. O-ring seal element 516 sealingly insulates the radial inner hollow space of large diameter portion 247a of cavity 247 from the atmosphere outside compressor 10.

Second valve control mechanism 500 further includes cupshaped casing 521 which houses annular electromagnetic coil 520, and annular cylindrical member 522 forcibly inserted within annular electromagnetic coil 520. A radial inner (bottom) end portion of annular cylindrical member 522 is forcibly inserted within circular depression 517 which is formed at a radial outer (upper) end surface of cylindrical member 510. Cylindrical pedestal 523 of magnetic material is fixedly disposed within a radial outer (upper) portion of annular cylindrical member 522. Cylindrical member 524 of magnetic material is radially slidably disposed within a radial inner (bottom) portion of annular cylindrical member 522.

Rod 524a is integrally formed with and extends downwardly from a radial inner (lower) end surface of cylindrical member 524. Rod 524a is slidably disposed in hole 518 which is radially formed through cylindrical member 510. A radial inner end of rod 524a projects into hole 513 and terminates at a position which is adjacent to ball valve member 530. Cylindrical member 524 includes cylindrical hollow space 524b formed at a radial outer (upper) end surface thereof. Coil spring 525 is resiliently disposed between the radial inner (lower) end surface of pedestal 523 and the radial inner (bottom) end surface of cylindrical hollow space 524b of cylindrical member 524 so that cylindrical member 524 is urged radially inwardly (downwardly) by the restoring force of coil spring 525.

Conduits 245, 246 and 248 are formed in rear end plate 24. Conduit 245 links suction chamber 241 in fluid communication to the front hollow space of large diameter portion 243a of cavity 243. Conduit 246 links hole 151 in fluid communication to the front hollow space of small diameter portion 243b of cavity 243. Conduit 248 links the radial inner (bottom) hollow space of small diameter portion 247b of second cylindrical cavity 247 in fluid communication with the front hollow space of small diameter portion 243b of first cylindrical cavity 243. Hole 249 is also formed in rear end plate 246 and links the radial inner (bottom) hollow space of large diameter portion 247a of cavity 247 in fluid communication with discharge chamber 251. A throttling device, such as, orifice tube 249a is fixedly disposed in hole 249.

In the first embodiment of the present invention, first communication path 400a linking suction chamber 241 in fluid communication with crank chamber 22 is formed by conduit 245, the front hollow space of large diameter portion 243a of cylindrical cavity 243, radial holes 406, cylindrical cavities 403 and 404, axial hole 405, the front hollow space of small diameter portion 243b of cylindrical cavity 243, conduit 246, hole 151, passage 150, bore 210, hole 221, hole 231, axial bore 262 and radial hole 263. Each element which forms part of first communication path 400a is designed so as to cause a negligible pressure reduction thereat. First valve control mechanism 400 in disposed within first communication path 400a.

Second communication path 500a linking discharge chamber 251 in fluid communication with crank chamber 22 is formed by hole 249, the radial inner (bottom) hollow space of large diameter portion 247a of cylindrical cavity 247, holes 515, circular holes 513a and 513, the radial inner (bottom) hollow space of small diameter portion 247b of cylindrical cavity 247, conduit 248, the front hollow space of small diameter portion 243b of cylindrical cavity 243, conduit 246, hole 151 and passage 150, bore 210, hole 221, hole 231, axial bore 262 and radial hole 263. Every element forming part of second communication path 500a is designed so as to cause a negligible pressure reduction thereat, except for hole 249 in which orifice tube 249a is fixedly disposed. Second valve control mechanism 500 is disposed within second communication path 500a at the downstream side of hole 249.

During operation of compressor 10, drive shaft 26 is rotated by the engine of the vehicle (not shown) through electromagnetic clutch 300. Cam rotor 40 rotates with drive shaft 26, causing slant plate 50 to rotate as well. The rotation of slant plate 50 causes wobble plate 60 to nutate. The nutating motion of wobble plate 60 reciprocates pistons 71 in their respective cylinders 70. As pistons 71 are reciprocated, refrigerant gas introduced into suction chamber 241 through the inlet portion is drawn into cylinders 70 through suction ports 242 and subsequently compressed. The compressed refrigerant gas is discharged from cylinders 70 to discharge chamber 251 through respective discharge ports 252 and then into the cooling circuit through the outlet portion.

Some of the partially compressed refrigerant gas in cylinders 70 is blown into crank chamber 22 from cylinders 70 through gaps formed between respective pistons 71 and cylinders 70 during the compression stroke of pistons 71. This gas is known as blow-by gas and causes an increase in pressure in the crank chamber relative to the suction chamber. This increase in relative pressure causes a decrease in the slant angle of the slant plate relative to a plane perpendicular to the drive shaft, reducing the displacement capacity of the compressor.

In operation of first valve control mechanism 400, the refrigerant gas conducted from suction chamber 241 to the front hollow space of large diameter portion 243a of cavity 243 via conduit 245 flows into cylindrical cavity 403 via holes 406. Therefore, the front surface of diaphragm 428 is acted upon by the pressure in suction chamber 241. On the other hand, the rear surface of diaphragm 428 is acted upon by fluid at atmospheric pressure which passes through the gap between the outer peripheral surface of cup-shaped casing 421 and the inner peripheral surface of annular projection 244, and the gap between the outer peripheral surface of annular plate member 427 and the inner peripheral surface of annular projection 244. Hence, the rear surface of diaphragm 428 is always acted upon by a constant value of pressure.

A first force which acts rearwardly on diaphragm 428 is the sum of the restoring force of coil spring 410 applied through valve member 407 and the force generated by the suction pressure which is received on the front surface of diaphragm 428. A second force which acts forwardly on diaphragm 428 is the sum of the restoring force of coil spring 426 which acts through cylindrical member 425 and the force generated by the atmospheric pressure which is received on the rear surface of diaphragm 428. Since the value of the restoring force of each of coil springs 410 and 426 are constant when coil springs 410 and 426 are selected, and the atmospheric pressure is constant, diaphragm 428 is bent forwardly and rearwardly in response to changes in the pressure in suction chamber 241. Accordingly, truncated cone shaped portion 407*a* of cylindrical valve member 407 moves forwardly and rearwardly so as to be received on and moved away from first valve seat 408 in response to changes in the pressure in suction chamber 241. That is, first communication path 400*a* is blocked or opened by cylindrical valve member 407 in response to changes in the pressure in suction chamber 241 so that the pressure in suction chamber 241 is adjusted so as to be maintained at a predetermined constant value.

A first electric current received by electromagnetic coil 422 as a first signal represents a value which is obtained by subtracting a predetermined set value from the measured value of the temperature of air flowing from the evaporator. Hereafter, the above-mentioned value is simply described as "the subtracted value," for purposes of explanation only. The subtracted value is correspondingly transformed to the magnitude of the amperage of the first electric current by a microcomputer (not shown). (The microcomputer forms the transformation in a known manner which does not form part of the invention.) The magnitude of the amperage of the first electric current is directly proportional to the subtracted value.

When electromagnetic coil 422 receives the first electric current from the microcomputer through a wire (not shown), a magnetic attraction force which rearwardly attracts cylindrical member 425 against the restoring force of coil spring 426 is generated. The magnitude of the magnetic attraction force may be varied in response to the changes in the magnitude of the amperage of the first electric current. Therefore, the axial position of cylindrical member 425 and the corresponding effect upon the rear surface of diaphragm 428 may be varied in response to changes in the magnitude of amperage of the first electric current.

Accordingly, the adjustable constant value of the pressure in suction chamber 241 is shifted in response to changes in the axial position of cylindrical member 425 which acts upon the rear of diaphragm 428. Therefore, the adjustable constant value of the pressure in suction chamber 241 is shifted in response to the changes in the magnitude of amperage of the first electric current, i.e., the changes in the subtracted value, and thus in response to changes in the temperature flowing from the evaporator.

For example, when the subtracted value is zero which is represented by a first magnitude of amperage of the first electric current, cylindrical member 425 is located at a first position so that the pressure in suction chamber 241 is adjusted to be maintained at a first constant value. If the subtracted value is changed from zero to a positive large value, that is, the temperature of the air flowing from the evaporator is increased indicating a large heat demand on the evaporator, the magnitude of amperage of the first electric current is changed from the first magnitude to a second magnitude which is greater than the first magnitude by a great amount.

Therefore, the magnitude of the attraction force acting to pull cylindrical member 425 rearwardly against the restoring force of coil spring 426 is increased with a great amount. Therefore, the axial location of cylindrical member 425 is changed from the first position to a second position which is rearward of the first position by a great distance. Accordingly, the adjustable constant value of the pressure in suction chamber 241 is shifted from the first constant value to a second constant value which is smaller than the first constant value by a great amount. Thus, the crank and suction chambers may be linked at a lower value of suction pressure, increasing capacity of the compressor to cool the vehicle.

On the other hand, if the subtracted value is changed from zero to a negative large value, that is, the temperature of the air flowing from the evaporator is decreased indicating a smaller heat demand on the evaporator, the magnitude of amperage of the first electric current is changed from the first magnitude to a third magnitude which is smaller than the first magnitude by a great amount. Therefore, the magnitude of the attraction force acting to pull cylindrical member 425 rearwardly against the restoring force of coil spring 426 is decreased a great amount. The axial location of cylindrical member 425 is changed from the first position to a third position which is forward of the first position by a great distance. Accordingly, the adjustable constant value of the pressure in suction chamber 241 is shifted from the first constant value to a third constant value which is greater than the first constant value by a great amount. Thus, the crank and suction chambers are not linked until a higher value of suction pressure is obtained, decreasing the capacity of the compressor to cool the vehicle.

In operation of second valve control mechanism 500 the amount by which the accelerator pedal of the vehicle is depressed is correspondingly transformed by the microcomputer to a magnitude of amperage of a second electric current, which is received by electromagnetic coil 520 as a second signal.

When the depression of the accelerator pedal is below a predetermined value, that is, when a large amount of power is not demanded from the engine of the vehicle to drive the vehicle, the second electric current is sent to electromagnetic coil 520 from the microcomputer via a wire (not shown). The magnitude of this current generates a magnetic attraction force sufficient to attract cylindrical member 524 upwardly against the restoring force of coil spring 525. Therefore, ball valve member 530 moves upwardly so as to be received on second valve seat 513*b*. Second communication path 500*a* linking discharge chamber 251 to crank chamber 22 is blocked. Accordingly, the capacity of compressor 10 is substantially controlled by operation of first valve control mechanism 400 in accordance with suction pressure and the temperature of the air flowing from the evaporator.

On the other hand, when the depressed amount of the accelerator pedal is equal to or exceeds the predetermined value, that is, when a large amount of power is demanded from the engine of the vehicle to drive the vehicle, for example, when the vehicle is accelerating or is being driven uphill, no second electric current is sent to electromagnetic coil 520 from the microcomputer. Thus, no magnetic attraction force is generated by electromagnetic coil 520 to act upon cylindrical member 524.

Therefore, cylindrical member 524 is urged downwardly by the restoring force of coil spring 525, so that ball valve member 530 moves downwardly by rod 524*a*. Ball valve is moved away from second valve seat 513*b*. Second communication path 500*a* is opened to link the crank and discharge chambers, regardless of whether the crank and suction chambers are linked by operation of first valve control mechanism 400. The discharge pressure rapidly flows to the crank chamber. Accordingly, the capacity of compressor 10 is quickly minimized by operation of second valve control mechanism 500.

At the time immediately after second valve control mechanism opens second communication path 500*a*, the refrigerant gas in the radial inner hollow space of large diameter portion 247*a* of cavity 247 which is maintained at the discharge chamber pressure, quickly flows into crank chamber 22 via holes 515, circular holes 513*a* and 513, the radial inner hollow space of small diameter portion 247*b* of cylindrical cavity 247, conduit 248, the front hollow space of small diameter portion 243*b* of cylindrical cavity 243, conduit 246, hole 151 and passage 150, bore 210, hole 221, hole 231, axial bore 262 and radial hole 263.

However, once second communication path 500*a* has been opened, refrigerant gas from discharge chamber 251 flows into the radial inner hollow space of large diameter portion 247*a* of cavity 247 with a reduced pressure due to the throttling effect of orifice tube 249*a*. Thereafter the reduced pressure fluid, flows into crank chamber 22 via holes 515, circular holes 513*a* and 513, the radial inner hollow space of small diameter portion 247*b* of cylindrical cavity 247, conduit 248, the radial front hollow space of small diameter portion 243*b* of cylindrical cavity 243, conduit 246, hole 151 and passage 150, bore 210, hole 221, hole 231, axial bore 262 and radial hole 263.

Accordingly, although the pressure in crank chamber 22 is quickly increased due to the flow of discharge pressure fluid from the hollow space of the large diameter portion 247*a* to quickly reduce the capacity of the compressor, the crank pressure is maintained at a certain value due to the throttling effect of orifice tube 249*a* which reduces the pressure of the gas flowing from the discharge chamber to the crank chamber. The desired amount of flow of fluid needed to maintain this level of crank pressure can be achieved by appropriate selection of the orifice tube. Alternatively, due to the fact that the first and second valve control mechanisms function independently, the desired flow can be maintained by opening and closing the second valve control mechanism under the control of the microcomputer.

The maintained value of the crank pressure relative is greater than the suction pressure by an amount which causes slant plate 50 to be positioned at the minimum slant angle, reducing the capacity of the compressor to the minimum value. Thus, though capacity of the compressor is rapidly reduced by the increase of crank pressure, the crank pressure is not rapidly and uncontrollably increased to a level which causes damage of the internal component parts of the compressor. Instead, the crank pressure is maintained at a safe operating level.

In the present invention, when the power demand on the engine by the vehicle is large, second communication path 500*a* is opened by virtue of operation of second valve control mechanism 500 in order to compulsorily quickly minimize the capacity of the compressor. The compressor capacity is reduced regardless of the demands made upon it by the cooling circuit of which it forms a part. Therefore, the power derived from the engine which is consumed in operation of the compressor is compulsorily minimized, without causing damage to the internal component parts of the compressor. Accordingly, maximum engine power is directed towards effectively driving the vehicle, for example, accelerating the vehicle or driving the vehicle uphill.

Figure 3:
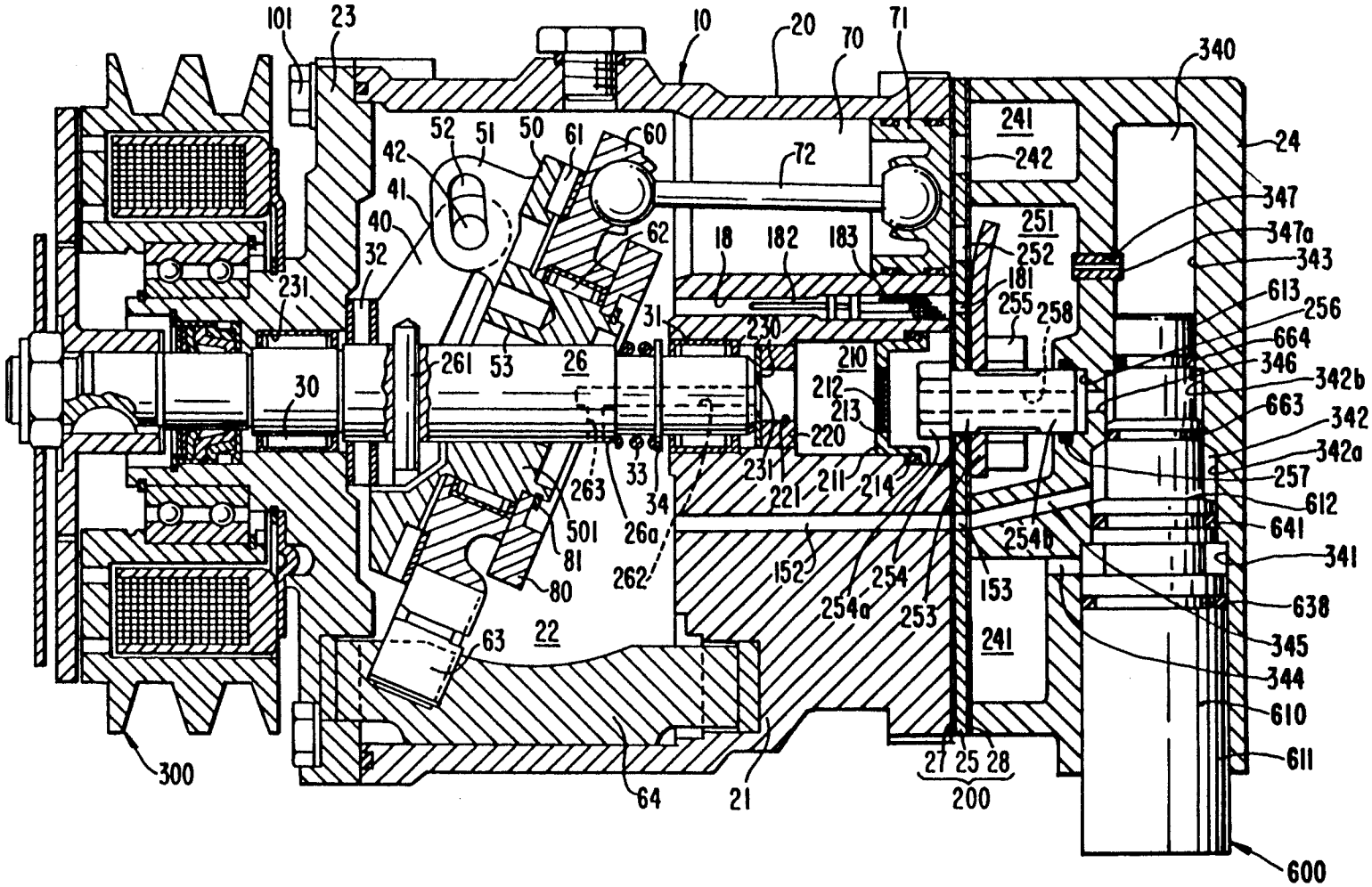
FIG. 3 is a longitudinal sectional view of a slant plate type compressor in accordance with a second embodiment of the present invention.

FIG. 3 illustrates the overall construction of a wobble plate type refrigerant compressor with a variable displacement mechanism in accordance with a second embodiment of the present invention. With reference to FIG. 3, compressor 10' is provided with rigid valve retainer 253 firmly fixed to a rear end surface of valve plate assembly 200 by bolt 254 and nut 255. One end portion of valve retainer 253 is located upon each discharge port 252, and is gradually bent rearwardly when the compressed refrigerant gas passes through discharge port 252 during the compression stroke of piston 71, in order to prevent excessive bending of the reed valve attached adjacent discharge port 252.

Bolt 254 includes head section 254*a* which is located in the rear end portion of central bore 210, and shaft section 254*b* which penetrates through valve plate assembly 200 and valve retainer 253. Shaft section 254*b* is disposed within discharge chamber 251. Shaft section 254*b* of bolt 254 is screwed into nut 255 so that valve retainer 253 is firmly fixed to valve plate assembly 200. A rear portion of shaft section 254*b* of bolt 254 is inserted into circular depression 256 which is formed at a central region of an inner surface of rear end plate 24. The rear end of shaft section 254*b* in located at a position which is approximate two-thirds of the way along the depth of circular depression 256.

O-ring seal element 257 is disposed at an inner peripheral surface of circular depression 256 so as to seal the mating surfaces between the outer peripheral surface of shaft section 254*b* of bolt 254 and the inner peripheral surface of circular depression 256. O-ring seal element 257 sealingly insulates a rear hollow space of circular depression 256 from discharge chamber 251. Conduit 258 is axially bored through bolt 254 so as to link central bore 210 to the rear hollow space of circular depression 256.

Radially extending cylindrical cavity 340 is formed in rear end plate 24 to the rear of suction and discharge chambers 241 and 251, along the approximate length of diameter of rear end plate 24. Cylindrical cavity 340 includes lower large diameter portion 341, intermediate portion 342 extending from an upper end of large diameter portion 341, and small diameter portion 343 extending from an upper end of intermediate portion 342. The diameter of cavity 340 is decreased in steps from bottom to top so as to form, in order, large, intermediate and small diameter portions 341, 342 and 343. Intermediate diameter portion 342 includes lower section 342*a* and upper section 342*b* extending from an upper end of lower section 342*d*. The diameter of lower section 342*a* is greater than the diameter of upper section 342*b*. Valve control device 600 is fixedly disposed in cylindrical cavity 340.

Figure 4:
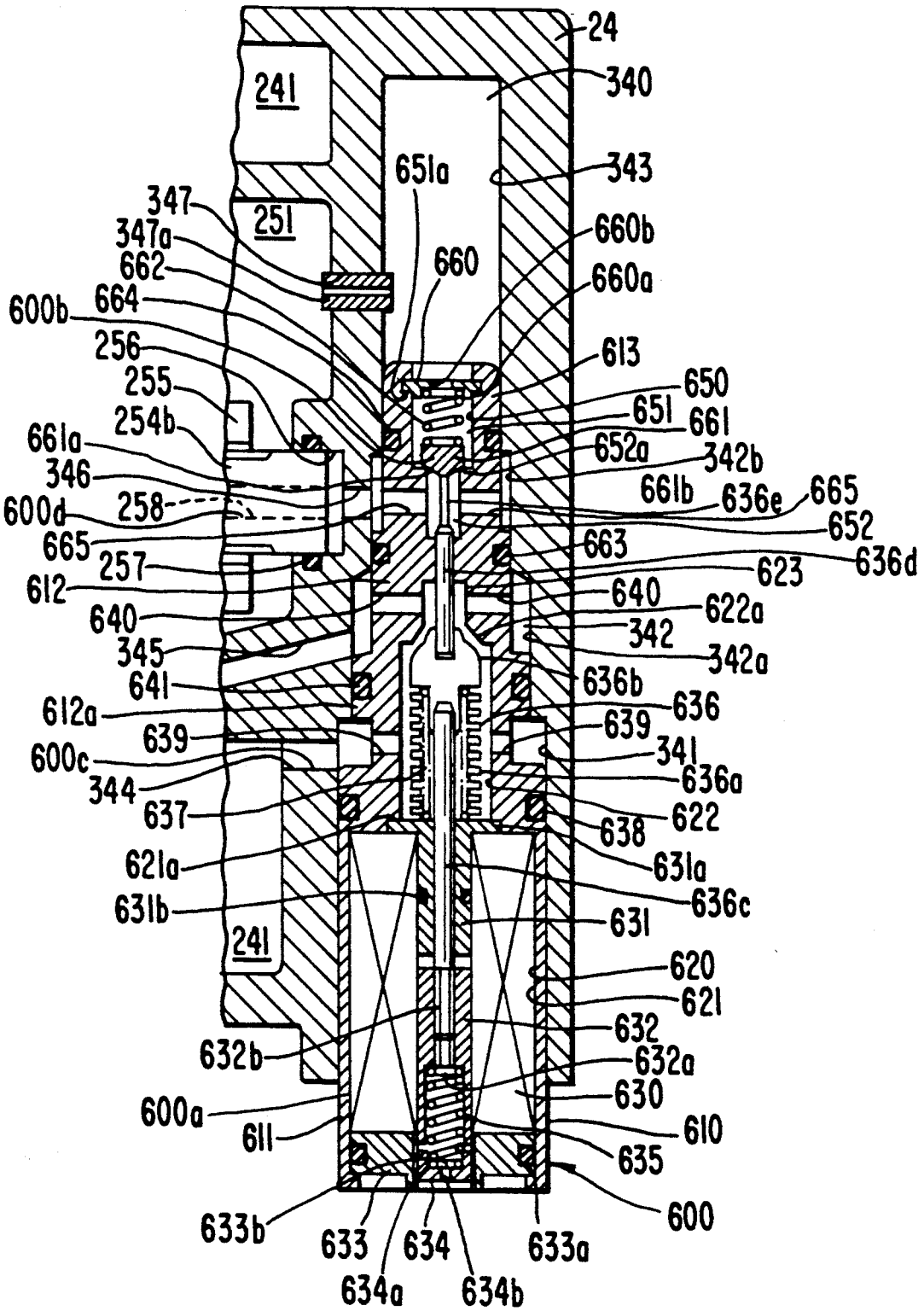
FIG. 4 is an enlarged fragmentary longitudinal sectional view of a valve control mechanism shown in FIG. 3.

With reference to FIG. 4, the construction of valve control device 600 is described in detail. Valve control device 600 includes cylindrical member 610 which comprises large, intermediate and small diameter regions 611, 612 and 613. Large, intermediate and small diameter regions 611, 612 and 613 of cylindrical member 610 are generally disposed in large, intermediate and small diameter portions 341, 342 and 343 of cavity 340, respectively. An upper end of small diameter region 613 of cylindrical member 610 is located at a position which is approximately one-fourth of the length of small diameter portion 343 of cavity 340. A lower end portion of large diameter region 611 of cylindrical member 610 projects from a side wall of rear end plate 24.

Cylindrical member 610 is provided with cylindrical cavity 620 formed therein. Cylindrical cavity 620 comprises large, intermediate and small diameter sections 621, 622 and 623, which extend sequentially upwardly in that order from the lower end surface of cylindrical member 610. An upper end of small diameter section 623 of cavity 620 terminates at a position which is approximate two-thirds of the length of intermediate diameter region 612 of cylindrical member 610. An upper end of large diameter section 621 of cavity 620 terminates at a position which is approximate five-sixths of the length of large diameter region 611 of cylindrical member 610. An upper end of intermediate diameter section 622 of cavity 620 terminates at a position which is approximate half way of the length of intermediate diameter region 612 of cylindrical member 610.

A lower end of small diameter section 623 of cavity 620 and the upper and of intermediate diameter section 622 of cavity 620 are linked by truncated cone section 622*a* which functions as a first valve seat. Annular ridge 621*a* is formed at the boundary between large and intermediate diameter sections 621 and 622. Annular electromagnetic coil 630 is fixedly disposed in large diameter section 621 of cavity 620. First annular cylindrical member 631 of magnetic material having outwardly extending annular flange 631*a* at its upper end is forcibly inserted into an upper portion of annular electromagnetic coil 630. A lower end of first annular cylindrical member 631 terminates at a position which is approximate half way of the length of annular electromagnetic coil 630. Annular flange 631*a* is sandwiched between annular ridge 621*a* and the upper end surface of annular electromagnetic coil 630.

Second annular cylindrical member 632 of magnetic material is radially slidably disposed in a lower portion of annular electromagnetic coil 630. Second annular cylindrical member 632 is provided with cylindrical depression 632*a* formed at a lower end surface thereof. Annular disc member 633 is fixedly disposed at a lower end of coil 630 by inwardly bending a lower end of cylindrical member 610. O-ring seal element 633*a* is disposed at an outer peripheral surface of annular disc member 633 to seal the mating surfaces between the outer peripheral surface of annular disc member 633 and the inner peripheral surface of large diameter section 621 of cavity 620.

Adjusting screw 634 having cylindrical depression 634*a* formed at an upper end surface thereof is screwed into a threaded inner peripheral surface 633*b* of annular disc member 633. Central hole 634*b* is formed through adjusting screw 634. Coil spring 635 is resiliently disposed between the upper surface of cylindrical depression 632*a* and the lower surface of cylindrical depression 634*a*. The value of the restoring force of coil spring 635 may be adjusted by changing the radial position of adjusting screw 634.

Bellows valve 636 having bellows 636*a* and valve member 636*b* fixedly connected to an upper end of bellows 636*a* is disposed in intermediate diameter section 622 of cavity 620. A lower end of bellows 636*a* is fixedly and hermetically connected to an upper end surface of annular flange 631*a* of first annular cylindrical member 631.

First rod 636*c* is disposed in an inner hollow space of bellows valve member 636. An upper end of first rod 636*c* is fixedly connected to valve member 636*b*. First rod 636*c* slidably penetrates through first annular cylindrical member 631. A lower end portion of first rod 636*c* is screwed into a threaded inner peripheral surface 632*b* of second annular cylindrical member 632 so that the lower end portion of first rod 636*c* is firmly connected to second annular cylindrical member 632. Coil spring 637 is disposed in the inner hollow space of bellows 636*a*, surrounding first rod 636*c*. Coil spring 637 is resiliently disposed between valve member 636*b* and annular flange 631*a* of first annular cylindrical member 631.

An interior space of bellows 636*a* is linked to the atmosphere outside of the compressor via axial hole 634*b* of adjusting screw 634, cylindrical depressions 634*a* and 632*a*, a gap created between the outer peripheral surface of rod 636*c* and the threaded inner peripheral surface 633*b* of annular disc member 633, and a gap created between the outer peripheral surface of rod 636*c* and the inner peripheral surface of first annular cylindrical member 631. Therefore, the interior space of bellows 636*a* is maintained at atmospheric pressure and has a substantially constant value. O-ring seal element 631*b* is disposed at an outer peripheral surface of first annular cylindrical member 631 to seal the mating surfaces between the outer peripheral surface of first annular cylindrical member 631 and the inner peripheral surface of annular electromagnetic coil 630.

O-ring seal element 638 is disposed at an outer peripheral surface of an upper end portion of large diameter region 611 of cylindrical member 610 to seal the mating surfaces between the outer peripheral surface of large diameter region 611 of cylindrical member 610 and the inner peripheral surface of large diameter portion 341 of cylindrical cavity 340. O-ring seal element 638 sealingly insulates an upper hollow space of large diameter portion 341 of cavity 340 from the atmosphere outside compressor 10'.

A plurality of holes 639 are formed in a lower portion of intermediate diameter region 612 of cylindrical member 610 so as to link intermediate diameter section 622 of cylindrical cavity 620 to the upper hollow space of large diameter portion 341 of cylindrical cavity 340. Hole 344 is formed in rear end plate 24 so as to link the upper hollow space of large diameter portion 341 of cavity 340 to suction chamber 241. A plurality of holes 640 are formed in an approximately mid portion of intermediate diameter region 612 of cylindrical member 610 so as to link small diameter section 623 of cylindrical cavity 620 to an upper hollow space of lower section 342*a* of intermediate diameter portion 342 of cavity 340.

O-ring seal element 641 is disposed at an outer peripheral surface of an outwardly extending annular flange 612*a* which is formed at an outer peripheral surface of intermediate diameter region 612 of cylindrical member 610, between holes 639 and holes 640, so as to seal the mating surfaces between the outer peripheral surface of annular flange 612*a* and the inner peripheral surface of lower section 342*a* of intermediate diameter portion 342 of cavity 340. O-ring seal element 641 sealingly insulates the upper hollow space of lower section 342*a* of intermediate portion 342 of cavity 340 from the upper hollow space of large diameter portion 341 of cavity 340.

Conduit 345 is formed in rear end plate 24 so as to link the upper hollow space of lower section 342*a* of intermediate diameter portion 342 of cavity 340 to one end of hole 153 which is formed through valve plate assembly conduit 200. The other end of hole 153 is linked to one end of conduit 152 which is formed through cylinder block 21. The other end of conduit 152 is opened to crank chamber 22.

Small diameter region 613 of cylindrical member 610 is provided with cylindrical cavity 650 formed therein. Cylindrical cavity 650 includes large diameter section 651 extending from an upper end surface of small diameter region 613 of cylindrical member 610 and small diameter section 652 extending from the lower end of large diameter section 651. Small diameter section 652 of cavity 650 terminates at a position which is at the lower end of small diameter region 613 of cylindrical member 610.

Annular ridge 652*a* is formed at the boundary between large and small diameter sections 651 and 652 of cavity 650 so as to function as a second valve seat. The diameter of small diameter section 652 of cylindrical cavity 650 is designed so as to allow a large amount of the refrigerant gas to flow through small diameter section 652 of cavity 650 even though small diameter portion 636*e* of second rod 636*d* (discussed below) is located in small diameter section 652 of cavity 650.

Circular disc member 660 is received on annular ridge 651*a* formed at an inner peripheral surface of upper portion of large diameter section 651 of cavity 650. Circular disc member 660 is firmly secured to annular ridge 651*a* by inwardly bending an upper end of small diameter region 613 of cylindrical member 610. Circular disc member 660 includes annular projection 660*a* downwardly projecting from a lower end surface of an outer peripheral portion of circular disc member 660. Circular disc member 660 includes hole 660*b* formed therethrough so as to link an upper hollow space to a lower hollow space of large diameter section 651 of cylindrical cavity 650.

Cylindrical valve member 661 having truncated cone portion 661*a* formed at a lower end thereof is radially movably disposed in large diameter section 651 of cavity 650. Valve member 661 further includes cylindrical depression 661*b* formed at a lower end surface of truncated cone portion 661*a*. Coil spring 662 is resiliently disposed between the lower end surface of circular disc member 660 and the upper end surface of cylindrical valve member 661 so that cylindrical valve member 661 is urged downwardly by the restoring force of coil spring 662. Truncated cone portion 661*a* of cylindrical valve member 661 is received on second valve seat 652*a* when cylindrical valve member 661 moves downwardly.

Bellows valve 636 is provided with second rod 636*d* of having one end firmly secured to a top portion of valve member 636*b* of bellows valve 636. Second rod 636*d* extends upwardly and slidably penetrates through intermediate diameter region 612 of cylindrical member 610 so that the other end of second rod 636*d* projects into small diameter section 652 of cylindrical cavity 650. Second rod 636*d* includes smaller diameter portion 636*e* which upwardly extends from the other end of second rod 636*d*. Smaller diameter portion 636*e* of second rod 636*d* terminates at a position which is adjacent to the upper (bottom) surface of cylindrical depression 661*b* of valve member 661.

O-ring seal element 663 is disposed at an outer peripheral surface of an upper portion of intermediate diameter region 612 of cylindrical member 610 so as to seal the mating surfaces between the outer peripheral surface of intermediate diameter region 612 of cylindrical member 610 and the inner peripheral surface of upper section 342*b* of intermediate diameter portion 342 of cavity 340. O-ring seal element 663 sealingly insulates an upper hollow space of upper section 342*b* of intermediate diameter portion 342 of cavity 340 from the upper hollow space of lower section 342*a* of intermediate diameter portion 342 of cavity 340.

O-ring seal element 664 is disposed at an outer peripheral surface of small diameter region 613 of cylindrical member 610 so as to seal the mating surfaces between the outer peripheral surface of small diameter region 613 of cylindrical member 610 and the inner peripheral surface of small diameter portion 343 of cavity 340. O-ring seal element 664 sealingly insulates the upper hollow space of upper section 342*b* of intermediate diameter portion 342 of cavity 340 from an upper hollow space of small diameter portion 343 of cavity 340.

A plurality of holes 665 are formed in small diameter region 613 of cylindrical member 610 between O-ring seal elements 663 and 664, so as to link the upper hollow space of small diameter section 652 of cavity 650 to the upper hollow space of upper section 342*b* of intermediate diameter-portion 342 of cavity 340. Hole 346 is formed in rear end plate 24 so as to link the upper hollow space of upper section 342*b* of intermediate diameter portion 342 of cavity 340 to the rear hollow space of circular depression 256. Hole 347 is formed in rear end plate 24 so as to link discharge chamber 251 to the upper hollow space of small diameter portion 343 of cavity 340. A throttling device such as, orifice tube 347*a* is fixedly disposed in hole 347.

In the second embodiment of the present invention, valve control device 600 includes first and second valve control mechanisms 600*a* and 600*b*. First valve control mechanism 600*a* is substantially formed by electromagnetic coil 630, second annular cylindrical member 632, first rod 636*c*, bellows valve 636 and first valve seat 622*a*. First communication path 600*c* linking suction chamber 241 in fluid communication with crank chamber 22 is formed by hole 344, the upper hollow space of large diameter portion 341 of cylindrical cavity 340, holes 639, intermediate diameter, truncated cone and small diameter sections 622, 622*a* and 623 of cylindrical cavity 620, holes 640, the upper hollow space of lower section 342*a* of intermediate diameter portion 342 of cylindrical cavity 340, conduit 345, hole 153 and conduit 152. Each element of first communication path 600*c* is designed so as to cause a negligible pressure reduction thereat. First valve control mechanism 600*a* is disposed within first communication path 600*c*.

Second valve control mechanism 600*b* is substantially formed by electromagnetic coil 630, second rod 636*d*, valve member 661 and second valve seat 652*a*. Second communication path 600*d* linking discharge chamber 251 in fluid communication with crank chamber is formed by hole 347, the upper hollow space of small diameter portion 343 of cylindrical cavity 340, the upper hollow space of large diameter section 651 of cylindrical cavity 650, hole 660*b*, the lower hollow space of large diameter section 651 of cylindrical cavity 650, small diameter section 652 of cylindrical cavity 650, holes 665, the upper hollow space of upper section 342*b* of intermediate diameter portion 342 of cylindrical cavity 340, hole 346, the rear hollow space of circular depression 256, conduit 258, bore 210, hole 221, hole 231, axial bore 262 and radial hole 263.

Every element of second communication path 600*d* is designed so as to cause a negligible pressure reduction thereat, except for hole 347 in which orifice tube 347*a* is fixedly disposed. Second valve control mechanism 600*b* is disposed within second communication path 600*d* at the downstream side of hole 347.

In the second embodiment of the present invention, with exception of valve control device 600, the operation of compressor 10' is substantially similar to the operation of compressor 10 described in the first embodiment of the present invention. Therefore, only the operation manner of valve control device 600 is described in detail below.

In operation of first valve control mechanism 600*a*, the refrigerant gas conducted from suction chamber 241 to the upper hollow space of large diameter portion 341 of cavity 340 via hole 344 flows into intermediate diameter section 622 of cylindrical cavity 620 via holes 639. Therefore, an exterior surface of bellows 636*a* receives the pressure in suction chamber 241 so that a first force tending to radially contract bellows 636*a* is generated. The contracting motion of bellows 636*a* moves valve member 636*b* of bellows valve 636 downwardly. The value of the first force varies in response to changes in the pressure in suction chamber 241.

A second force tending to move valve member 636*b* upwardly is the sum of the restoring force of coil spring 637 and the restoring force of coil spring 635. The value of the restoring force of coil spring 637 is constant. The value of spring 635 may be adjusted by adjusting screw 634*a*, but remains constant throughout compressor operation. Thus, valve member 636*b* of bellows valve 636 is moved downwardly and upwardly in response to the changes in the pressure in suction chamber 241.

Accordingly, valve member 636*b* moves upwardly and downwardly so as to be received on and moved away from first valve seat 622*a* in response to the changes in the pressure in suction chamber 241. That is, first communication path 600*c* is blocked and opened by valve member 636*b* of bellows valve 636 in response to the changes in the pressure in suction chamber 241 so that the pressure in suction chamber 241 is maintained at a predetermined constant value.

A first electric current received by electromagnetic coil 630 as a first signal represents the subtracted value, as discussed above with respect to the first embodiment. The subtracted value is correspondingly transformed to the magnitude of the amperage of the first electric current by a micro computer (not shown). The magnitude of amperage of the first electric current is inversely proportional to the subtracted value.

A second electric current also received by electromagnetic coil 630 as a second signal represents the amount by which the accelerator pedal of the vehicle is depressed. The depression of the accelerator pedal of the vehicle is correspondingly transformed to the magnitude of amperage of the second electric current by the microcomputer.

When electromagnetic coil 630 receives the first electric current from the microcomputer through a wire (not shown), a magnetic attraction force is created which moves cylindrical member 632 upwardly, thereby moving upwardly valve member 636*b* of bellows valve 636 through first rod 636*c*. The magnitude of the magnetic attraction force varies in response to the changes in the magnitude of amperage of the first electric current. Therefore, the radial position of cylindrical member 632 varies in response to changes in the magnitude of amperage of the first electric current. Thus, the adjustable constant value of the pressure in suction chamber 241 is shifted in response to changes in the radial position of cylindrical member 632. Therefore, the adjustable constant value of the pressure in suction chamber 241 is shifted in response to changes in the magnitude of the amperage of the first electric current, i.e., the changes in the subtracted value.

For example, when the subtracted value is zero which is represented by a first magnitude of amperage of the first electric current, cylindrical member 632 is located at a first position so that the pressure in suction chamber 241 is maintained at a first constant value. If the subtracted value is changed from zero to a large positive value, the magnitude of the amperage of the first electric current is changed from the first magnitude to a second magnitude which is smaller than the first magnitude by a great amount. Therefore, the magnitude of the force upwardly attracting cylindrical member 632 against the first force is decreased with a great amount. Therefore, the radial location of cylindrical member 632 is changed from the first position to a second position which is downward of the first position by a large distance. Accordingly, the constant pressure maintained in the suction chamber 241 is shifted from the first constant value to a second constant value which is smaller than the first constant value by a great amount.

On the other hand, if the subtracted value is changed from zero to a large negative value, the magnitude of the amperage of the first electric current is changed from the first magnitude to a third magnitude which is greater than the first magnitude by a large amount. The magnitude of the force upwardly attracting cylindrical member 632 against the first force is increased a great amount. Therefore, the radial location of cylindrical member 632 is changed from the first position to a third position which is upward away from the first position by a large distance. Accordingly, the constant value of the pressure maintained in suction chamber 241 is shifted from the first constant value to a third constant value which is greater than the first constant value by a great amount.

Furthermore, the microcomputer varies the magnitude of the amperage of the first electric current from zero to the predetermined magnitude in response to changes in the subtracted value. When electromagnetic coil 630 receives the first electric current having a magnitude of amperage varying from zero to the predetermined maximum magnitude in dependence upon the subtracted value, first valve control mechanism 600*a* operates normally to control compressor capacity in dependence upon the heat load on the cooling circuit.

In operation of second valve control mechanism 600*b*, when the depressed amount of the accelerator pedal is below a predetermined value, that is, when the power demands upon the engine of the vehicle are not large, the first signal overrides the second signal in the processing of the microcomputer. Therefore, the electromagnetic coil 630 receives only the first electric current from the microcomputer. Accordingly, the capacity of compressor 10', is normally controlled by operation of first valve control mechanism 600*a*.

On the other hand, when the depressed amount of the accelerator pedal is equal to or exceeds the predetermined value, that is, when the power demands upon the engine of the vehicle are large, for example, when accelerating the vehicle or driving the vehicle uphill, the microcomputer calculates whether the difference between the magnitude of amperage of the first electric current at the present time and the predetermined maximum magnitude of amperage of the first electric current, exceeds a further predetermined value.

If the above-mentioned difference does exceed the predetermined value, the first signal is overridden by the second signal in the processing of the microcomputer so that electromagnetic coil 630 receives the second electric current from the microcomputer through the wire. The second electric has an amperage which is the predetermined maximum magnitude of amperage of the first electric current. Therefore, the increase in the magnetic attraction force acting upwardly upon cylindrical member 632 is large so that cylindrical member 632 is moved upwardly against the first force until valve member 636*b* of bellows valve 636 is received on first valve seat 622*a*. The crank and suction chambers are isolated.

Concurrently cylindrical valve member 661 is moved upwardly against the restoring force of coil spring 662 through first rod 636*c*, valve member 636*b* of bellows valve 636 and second rod 636*d* so that cylindrical valve member 661 is removed from second valve seat 652*a*. Therefore, second communication path 600*d* linking discharge chamber 251 to crank chamber 22 is opened so that the capacity of compressor 10' is quickly minimized.

On the other hand, if the above-mentioned difference does not exceed the predetermined amount, the first signal still overrides the second signal in the processing of the microcomputer. Therefore, the capacity of compressor 10' is still controlled by operation of first valve control mechanism 600*a* in response to the first electric current.

Immediately after the second communication path 600*d* is opened, the refrigerant gas in the upper hollow space of small diameter portion 343 of cavity 340, which is maintained at the discharge chamber pressure, quickly flows into crank chamber 22 via the upper hollow space of large diameter section 651 of cavity 650, hole 660*b*, the lower hollow space of large diameter section 651 of cavity 650, small diameter section 652 of cavity 650, holes 665, the upper hollow space of upper section 342*b* of intermediate diameter portion 342 of cylindrical cavity 340, hole 346, the rear hollow space of circular depression 256, conduit 258, bore 210, hole 221, hole 231, axial bore 262 and radial hole 263.

However, once second communication path 600*d* has been opened, the refrigerant gas in discharge chamber 251 flows into the hollow space of small diameter portion 343 of cavity 340 with a reduction in pressure thereof due to the throttling effect of orifice tube 347*a*, and then flows into crank chamber 22 via the upper hollow space of large diameter section 651 of cavity 650, hole 660*b*, the lower hollow space of large diameter section 651 of cavity 650, small diameter section 652 of cavity 650, holes 665, the upper hollow space of upper section 342*b* of intermediate diameter portion 342 of cylindrical cavity 340, hole 346, the rear hollow space of circular depression 256, conduit 258, bore 210, hole 221, hole 231, axial bore 262 and radial hole 263.

Accordingly, the pressure in crank chamber 22 is quickly increased but is maintained at a certain value which relative to the suction pressure, causes slant plate 50 to be positioned in the minimum slant angle. That is, the capacity of the compressor is minimized. However, the crank pressure is not increased to a level which would cause damage to the internal component parts of the compressor.

In the event that a large amount of power is demanded from the engine of the vehicle, second communication path 600*d* is opened by virtue of operation of second valve control mechanism 600*b* in order to compulsorily quickly minimize the capacity of the compressor. Therefore, the energy which is derived from the engine to be consumed in operation of the compressor is compulsorily minimized without causing damage to the internal component parts of the compressor. Accordingly, the energy derived from the engine of the vehicle is effectively used for accelerating the vehicle or driving the vehicle uphill, regardless of the demands made on the compressor by the cooling circuit.

Figure 5:
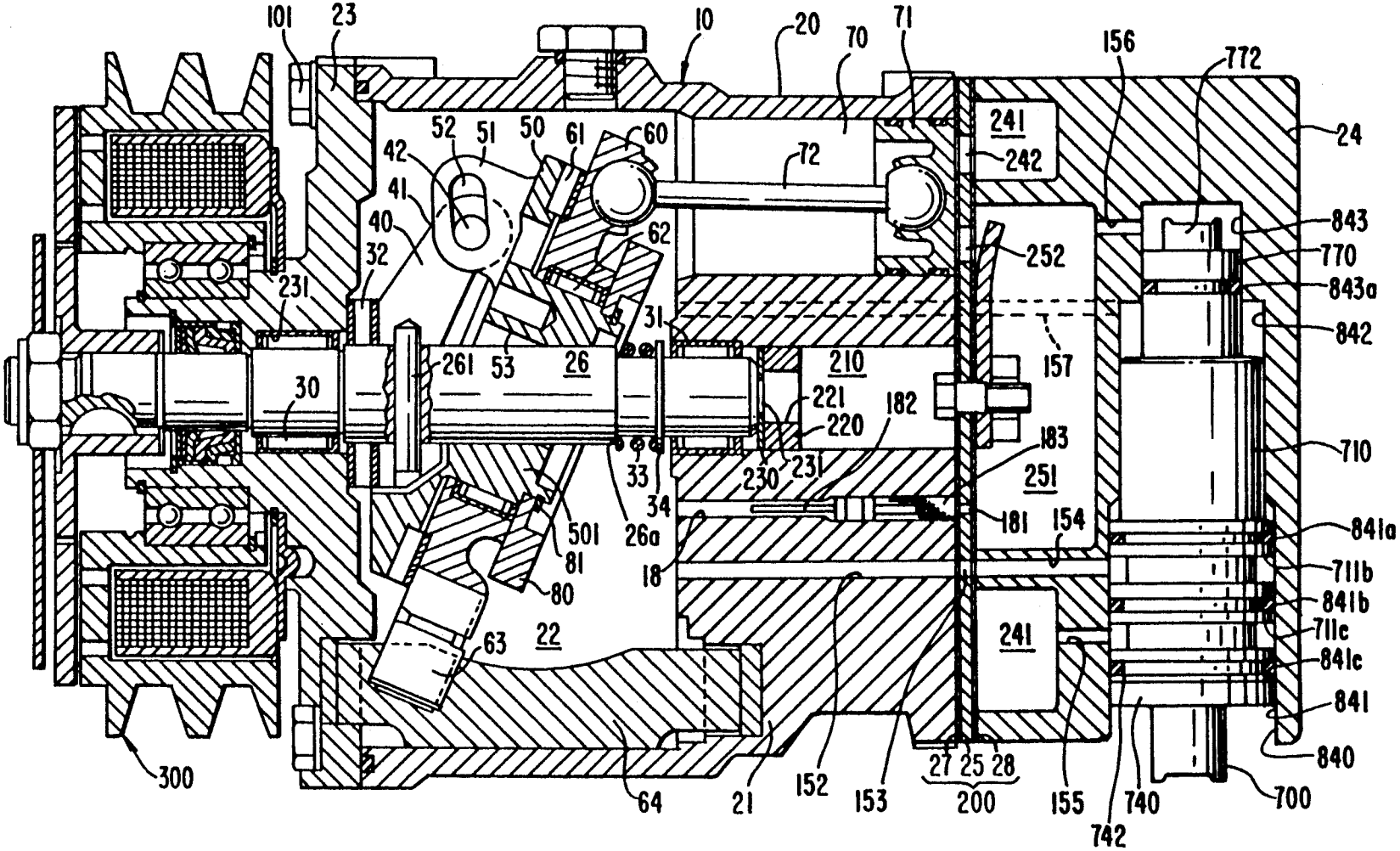
FIG. 5 is a longitudinal sectional view of a slant plate type compressor in accordance with a third embodiment of the present invention.

FIG. 5 illustrates the overall construction of a wobble plate type refrigerant compressor with a variable displacement mechanism in accordance with a third embodiment of the present invention. With reference to FIG. 5, compressor 10'' is provided with valve control device 700 disposed within radially extending cylindrical cavity 840 which is formed in rear and plate 24 at a rear of suction and discharge chambers 241 and 251 along the approximate length of diameter of rear end plate 24. Cylindrical cavity 840 includes large diameter portion 841, intermediate portion 842 extending from an upper end of large diameter portion 841, and small diameter portion 843 extending from an upper end of intermediate portion 842. Along the length of the diameter, the value is steppedly decreased in order of larger intermediate and small diameter portions 841, 842 and 843.

Figure 6:
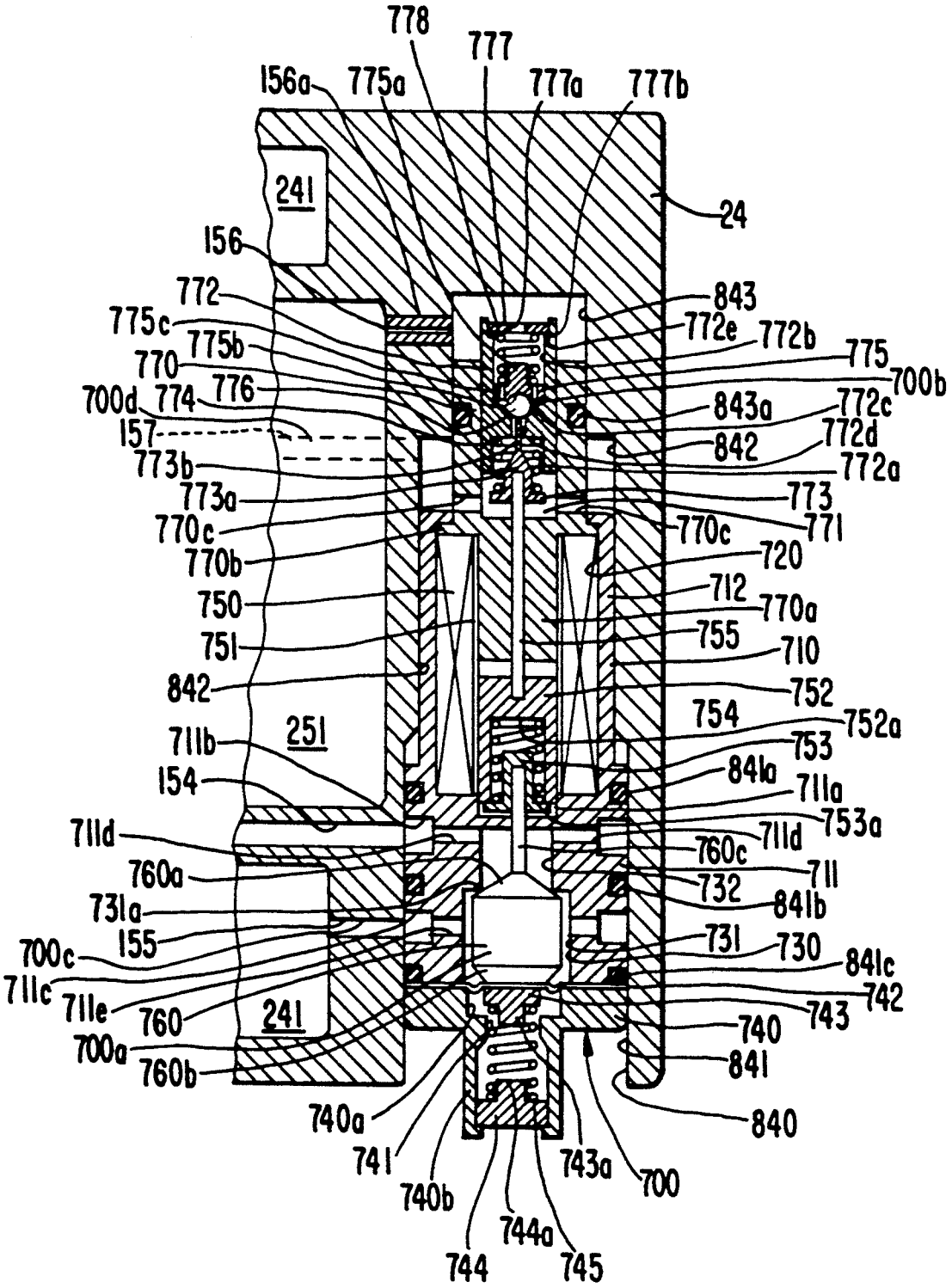
FIG. 6 is an enlarged fragmentary longitudinal sectional view of a valve control mechanism shown in FIG. 5.

With reference to FIG. 6 additionally, the construction of valve control device 700 is described in detail below. Valve control device 700 includes cylindrical member 710 having large diameter region 711 and small diameter region 712 which extends from an upper end surface of large diameter region 711. Large and small diameter regions 711 and 712 of cylindrical member 710 are fixedly disposed in large and intermediate diameter portions 841 and 842 of cavity 840, respectively.

Cylindrical member 710 is provided with first cylindrical cavity 720 and second cylindrical cavity 730 formed therein. First cylindrical cavity 720 extends from an upper end surface of small diameter region 712 of cylindrical member 710 and terminates at a position which is immediately below an upper end of large diameter region 711 of cylindrical member 710. Second cylindrical cavity 730 extends from a lower end surface of large diameter region 711 of cylindrical member 710 and terminates at a position which is approximately two-thirds of the length of large diameter region 711 of cylindrical member 710.

Second cylindrical cavity 730 includes large diameter portion 731 and small diameter portion 732 which extends from an upper end of large diameter portion 731. Annular ridge 731*a* functioning as a first valve seat is formed at the boundary between large and small diameter portions 731 and 732.

Circular plate member 740 located at the lower end side of cylindrical member 710 is fixedly disposed in cylindrical cavity 840. Circular plate member 740 is provided with circular depression 740*a* formed at an upper end surface thereof. Circular plate member 740 includes cylindrical projection 740*b* downwardly projecting from a lower end surface thereof. Circular hole 741 is formed through cylindrical projection 740*b* and is linked to circular depression 740*a* at its upper end.

Diaphragm 742 is fixedly sandwiched between the lower end surface of cylindrical member 710 and the upper end surface of circular plate member 740. An upper surface of a central region of diaphragm 742 faces to a large diameter portion 731 of second cylindrical cavity 730, and a lower surface of a central region of diaphragm 742 faces circular depression 740*a* of circular plate member 740.

Cylindrical member 743 is radially slidably disposed in circular depression 740*a* of circular plate member 740. Cylindrical member 743 includes circular projection 743*a* downwardly extending from a lower end surface thereof. Adjusting screw 744 is screwed into hole 741. Adjusting screw 744 includes circular projection 744*a* upwardly projecting from an upper end surface thereof. Coil spring 745 is resiliently disposed between cylindrical member 743 and adjusting screw 744 and surrounds projections 743*a* and 744*a*.

Cylindrical member 743 is urged upwardly by the restoring force of coil spring 745 so that an upper end surface of cylindrical member 743 is in contact with the lower surface of the central region of diaphragm 742. The value of the restoring force of coil spring 745 is adjusted by changing the radial location of adjusting screw 744.

Annular electromagnetic coil 750 is fixedly disposed in first cylindrical cavity 720. Annular cylindrical member 751 is fixedly disposed within annular electromagnetic coil 750. Cylindrical member 752 of magnetic material is radially slidably disposed within a lower half portion of annular cylindrical member 751. Cylindrical member 752 is provided with cylindrical depression 752*a* formed at a lower end surface thereof. Cylindrical depression 752*a* extends from the lower end surface of cylindrical member 752 and terminates at a position which is approximate half way of the length of cylindrical member 752. A lower end of cylindrical member 752 projects into circular depression 711*a* formed at the upper end surface of large diameter region 711 of cylindrical member 710.

Cylindrical valve member 760 is radially movably disposed within large diameter portion 731 of second cylindrical cavity 730. Cylindrical valve member 760 includes first truncated cone portion 760*a* formed at an upper end surface thereof and second truncated cone portion 760*b* formed at a lower end surface thereof. Lower end surface of second truncated cone portion 760*b* is in contact with the upper surface of diaphragm 742. First truncated cone portion 760*a* is received on first valve seat 731*a* when cylindrical valve member 760 is moved upwardly.

Rod 760*c* upwardly extending from an upper end surface of first truncated cone portion 760*a* slidably penetrates through large diameter region 711 of cylindrical member 710. A top end of rod 760*c* projects into cylindrical depression 752*a* of cylindrical member 752 through circular depression 711*a*. Cylindrical member 753 is radially movably disposed within cylindrical depression 752*a* and is firmly connected to the top end of rod 760*c*. Cylindrical member 753 includes an outwardly extending annular flange 753*a* formed at a lower end thereof.

Cylindrical member 770 is fixedly disposed in small diameter portion 843 of cylindrical cavity 840. A lower half portion of cylindrical member 770 projects into intermediate diameter portion 842 of cavity 840. A lower end surface of cylindrical member 770 is in contact with an annular upper end surface of electromagnetic coil 750. Cylindrical projection 770*a* of magnetic material projecting from the lower and surface of cylindrical member 770 is forcibly inserted into annular cylindrical member 751. An outwardly extending annular flange 770*b* is formed at a lower end of cylindrical member 770. Annular flange 770*b* is secured to the upper end of cylindrical member 710 by firmly inwardly bending the upper end of cylindrical member 710.

Cylindrical member 770 is provided with cylindrical cavity 771 formed therein. Cylindrical cavity 771 extends from an upper end surface of cylindrical member 770 and terminates at a position which is adjacent to a lower end of cylindrical member 770. Cylindrical member 772 is fixedly disposed in cylindrical cavity 771. A lower end of cylindrical member 772 is located at a position which is approximate one-third of the length of cylindrical cavity 771. An upper end of cylindrical member 772 upwardly projects from the upper end surface of cylindrical member 770.

Cylindrical member 772 includes first cylindrical depression 772*a* formed at a lower end surface thereof and second cylindrical depression 772*b* formed at an upper end surface thereof. A diameter of a lower end portion of second cylindrical depression 772*b* is gradually decreased in the downward direction so as to form second valve seat 772*c*.

Hole 772*d* is formed in cylindrical member 772 so as to link first and second cylindrical depressions 772*a* and 772*b*. A diameter of hole 772*d* is designed so as to allow a large amount of the refrigerant gas to flow through hole 772*d* even though small diameter portion 773*b* of rod 773*a* is located in hole 772*d*.

First circular plate 773 is radially movably disposed in a lower end portion of cylindrical cavity 771. Rod 773*a* projects upwardly from an upper end surface of first circular plate 773. Rod 773*a* includes small diameter portion 773*b* extending from an upper end surface thereof. Small diameter portion 773*b* of rod 773*a* radially movably penetrates through hole 772*d*. Coil spring 774 is resiliently disposed between the bottom surface of first cylindrical depression 772*a* of cylindrical member 772 and the upper end surface of first circular plate 773 and surrounds rod 773*a*.

Second circular plate 775 is radially slidably disposed within second cylindrical depression 772*b* of cylindrical member 772. Second circular plate 775 includes circular projection 775*a* which upwardly projects from an upper end surface of second circular plate 775, and concave depression 775*b* which is formed at a lower end surface of second circular plate 775 so as to be able to receive ball valve member 776 therein. A plurality of holes 775*c* are formed through second circular plate 775 so as to link an upper to a lower hollow space of second cylindrical depression 772*b* as formed with respect to second circular plate 775.

Third circular plate 777 having a central hole 777*a* is disposed at an upper portion of cylindrical member 772. Third circular plate 777 includes annular projection 777*b* downwardly projecting from an outer periphery of a lower end surface thereof. Annular projection 777*b* is received on annular ridge 772*e* formed at an upper portion of an inner peripheral surface of second cylindrical depression 772*b*. Third circular plate 777 is firmly secured to the upper portion of cylindrical member 772 by inwardly bending the upper end of cylindrical member 772.

Rod 755 radially slidably penetrating through cylindrical projection 770*a* is fixedly connected to first circular plate 773 at its upper end. A lower end of rod 755 is fixedly connected to an upper end portion of cylindrical member 752. Coil spring 778 is resiliently disposed between the lower end surface of third circular plate 777 and the upper end surface of second circular plate 775 and surrounds circular projection 775*a*. The restoring force of coil spring 778 urges second circular plate 775 downwardly so that ball valve member 776 is urged downwardly.

Coil spring 754 is resiliently disposed between the upper end surface of annular flange 753*a* of cylindrical member 753 and the upper surface of cylindrical depression 752*a*. When the restoring force of coil spring 754 is appropriately selected, the upper end surface of annular flange 753*a* of cylindrical member 753 is maintained to be in contact with a lower end surface of cylindrical member 752 by the restoring force of coil springs 774 and 745.

However, when cylindrical member 752 is further moved upwardly in a situation in which first truncated cone portion 760*a* of cylindrical valve member 760 is received on first valve seat 731*a*, the lower end surface of cylindrical member 752 is moved away from the upper end surface of annular flange 753*a* of cylindrical member 753. Furthermore, when cylindrical member 752 moves downwardly from a situation in which the lower end surface of cylindrical member 752 is not in contact with the upper end surface of annular flange 753*a* of cylindrical member 753, the lower end surface of cylindrical member 752 can softly contact with the upper end surface of annular flange 753*a* of cylindrical member 753 through coil spring 754.

First and second annular grooves 711*b* and 711*c* are formed at an outer peripheral surface of large diameter region 711 of cylindrical member 710. First annular groove 711*b* is located above second annular groove 711*c*. A plurality of first holes 711*d* link first annular groove 711*b* to small diameter portion 732 of second cylindrical cavity 730. A plurality of second holes 711*e* link second annular groove 711*c* to large diameter portion 731 of second cylindrical cavity 730. Conduits 154 and 155 are formed in rear end plate 24. Conduit 154 links first annular groove 711*b* to crank chamber 22 through hole 153 and conduit 152. Conduit 155 links second annular groove 711*c* to suction chamber 241.

First, second and third O-ring seal elements 841*a*, 841*b* and 841*c* are disposed at the outer peripheral surface of large diameter region 711 of cylindrical member 710 to seal the mating surfaces between the outer peripheral surface of large diameter region 711 of cylindrical member 710 and the inner peripheral surface of large diameter portion 841 of cylindrical cavity 840. First O-ring seal element 841*a* is located above first annular groove 711*b*. Second O-ring seal element 841*b* is located between first and second annular grooves 711*b* and 711*c*. Third O-ring seal element 841*c* is located below second annular groove 711*c*, adjacent to diaphragm 742.

First O-ring seal element 841*a* sealingly insulates an upper hollow space of large diameter portion 841 of cylindrical cavity 840 from first annular groove 711*b*. Second O-ring seal element 841*b* sealingly insulates first annular groove 711*b* from second annular groove 711*c*. Third O-ring seal element 841*c* sealingly insulates second annular groove 711*c* from the atmosphere outside of compressor 10".

Fourth O-ring seal element 843*a* is disposed at an outer peripheral surface of cylindrical member 770 to seal the mating surfaces between the outer peripheral surface of cylindrical member 770 and the inner peripheral surface of small diameter portion 843 of cylindrical cavity 840. Fourth O-ring seal element 843*a* sealingly insulates an upper hollow space of small diameter portion 843 of cavity 840 from an upper hollow space of intermediate diameter portion 842 of cavity 840.

A plurality of holes 770C are bored through cylindrical member 770 so as to link the upper hollow space of intermediate diameter portion 842 to the lower end portion of cylindrical cavity 771. Hole 156 is formed in rear end plate 24 so as to link the upper hollow space of small diameter portion 843 of cavity 840 to discharge chamber 251. A throttling device, such as orifice tube 156*a* is fixedly disposed in hole 156. Conduit 157 is axially bored through cylinder block 21, valve plate assembly 200 and rear end plate 24 so as to link the upper hollow space of intermediate portion 842 of cavity 840 to crank chamber 22.

In the third embodiment of the present invention, valve control device 700 includes first and second valve control mechanism 700*a* and 700*b*. First valve control mechanism 700*a* is substantially formed by diaphragm 742, cylindrical valve member 760, first valve seat 731*a*, cylindrical member 753, rod 760*c*, cylindrical member 752 and electromagnetic coil 750. First communication path 700*c* linking suction chamber 241 to crank chamber 22 is formed by conduit 155, second annular groove 711*c*, holes 711*e*, large and small diameter portions 731 and 732 of cylindrical cavity 730, holes 711*d*, first annular groove 711*b*, conduit 154, hole 153 and conduit 152. Every element of first communication path 700*c* is designed so as to cause a negligible pressure reduction thereat. First valve control mechanism 700*a* is disposed within first communication path 700*c*.

Second valve control mechanism 700*b* is substantially formed by ball valve member 776, second valve seat 772*c*, rod 755, first circular plate 773 and electromagnetic coil 750. Furthermore, second communication path 700*d* linking discharge chamber 251 to crank chamber 22 is formed by hole 156, the upper hollow space of small diameter portion 843 of cylindrical cavity 840, hole 777*a*, the upper hollow space of second cylindrical depression 772*b*, holes 775*c*, the lower hollow space of second cylindrical depression 772*b*, hole 772*d*, first cylindrical depression 772*a*, cylindrical cavity 771, holes 770*c*, the upper hollow space of intermediate diameter portion 842 of cylindrical cavity 840 and conduit 157. Every element of second communication path 700*d* is designed so as to cause a negligible pressure reduction thereat, except for hole 156 in which orifice tube 156*a* is fixedly disposed. Second valve control mechanism 700*c* is disposed within second communication path 700*d* at the downstream side of hole 156.

In the third embodiment of the present invention, the operation of compressor 10" is also substantially similar to the operation of compressor 10 described in the first embodiment of the present invention, with the exception of the operation of valve control device 700. Therefore, the operational manner of valve control device 700 is described in detail below.

In operation of first valve control mechanism 700*a*, the refrigerant gas conducted from suction chamber 241 to second annular groove 711*c* via conduit 155 flows into large diameter portion 731 of cylindrical cavity 730 via holes 711*e*. Therefore, an upper surface of diaphragm 742 receives the pressure in suction chamber 241. On the other hand, a lower surface of diaphragm 742 receives pressure in the atmosphere which flows from outside of the compressor to circular depression 740*a* via the gap created between the outer peripheral surface of adjusting screw 744 and the inner peripheral surface of circular hole 741. Hence, the lower surface of diaphragm 742 always receives a constant value of pressure.

A first force downwardly acting on diaphragm 742 is the sum of the restoring force of coil spring 774 and the force generated by the suction pressure which is received on the upper surface of diaphragm 742. A second force upwardly acting on diaphragm 742 is the sum of the restoring force of coil spring 745 and the force generated by the atmospheric pressure which is received on the lower surface of diaphragm 742. Since the value of the restoring force of each of coil springs 774 and 745 are constant when coil spring 774 is selected and when the restoring force of coil spring 745 is adjusted, diaphragm 742 is bent upwardly and downwardly in response to the changes in the pressure in suction chamber 241.

Accordingly, first truncated cone shaped portion 760*a* of cylindrical valve member 760 moves upwardly and downwardly so as to be received on and moved away from first valve seat 731*a* in response to the changes in the pressure in suction chamber 241. That is, first communication path 700*c* is blocked and opened by cylindrical valve member 760 in response to the changes in the pressure in suction chamber 241 so that the pressure in suction chamber 241 is maintained at a predetermined constant value.

A first electric current received by electromagnetic coil 750 as a first signal represents the subtracted value as discussed above. A second electric current also received by electromagnetic coil 750 as a second signal represents the depressed amount of the accelerator of the vehicle. The subtracted value is correspondingly transformed to the magnitude of amperage of the first electric current in a process in a microcomputer (not shown). The magnitude of amperage of the first electric current is inversely proportional to the subtracted value.

When electromagnetic coil 750 receives the first electric current from the microcomputer through a wire (not shown) a magnetic attraction force is generated which upwardly attracts cylindrical member 752 against the restoring force of coil spring 774, thereby upwardly moving cylindrical valve member 760 through rod 760*c* and cylindrical member 753. The magnitude of the magnetic attraction force is varied in response to the changes in the magnitude of amperage of the first electric current.

Therefore, a radial position of cylindrical member 752 is varied in response to the changes in the magnitude of amperage of the first electric current. The maintained constant value of the pressure in suction chamber 241 is shifted in response to the changes in the radial position of cylindrical member 752. Therefore, the constant value of the pressure in suction chamber 241 is shifted in response to changes in the magnitude of amperage of the first electric current, i.e., the changes in the subtracted value.

For example, when the subtracted value is zero which is represented by a first magnitude of amperage of the first electric current, cylindrical member 752 is located at a first position so that the pressure in suction chamber 241 is maintained at a first constant value.

If the subtracted value is changed from zero to a positive large value, the magnitude of amperage of the first electric current is changed from the first magnitude to a second magnitude which is smaller than the first magnitude by a great amount. Therefore, the magnitude of the attraction force acting upwardly on cylindrical member 752 against the restoring force of coil spring 774 is decreased a great amount. Therefore, the radial location of cylindrical member 752 is changed from the first position to a second position which is downward from the first position a long distance. Accordingly, the maintained constant value of the pressure in suction chamber 241 is shifted from the first constant value to a second constant value which is smaller than the first constant value by a great amount.

On the other hand, if the subtracted value is changed from zero to a negative large value, the magnitude of amperage of the first electric current is changed from the first magnitude to a third magnitude which is greater than the first magnitude by a great amount. Therefore, the magnitude of the attraction force acting upwardly on cylindrical member 752 against the restoring force of coil spring 774 is increased a great amount. Therefore, the radial location of cylindrical member 752 is changed from the first position to a third position which is above the first position a long distance. Accordingly, the maintained constant value of the pressure in suction chamber 241 is shifted from the first constant value to a third constant value which is greater than the first constant value by a great amount.

In operation of second value control mechanism 700*b*, when the depressed amount of the accelerator pedal is below a predetermined value, that is, when the power demand upon the engine of the vehicle is not large, the first signal overrides the second signal in the processing of the microcomputer. Therefore electromagnetic coil 750 receives only the first electric current. Accordingly, the capacity of compressor 10" is controlled by operation of first valve control mechanism 700*a*.

On the other hand, when the depressed amount of the accelerator pedal is equal to or exceeds the predetermined value, that is, when the power demands on the engine of the vehicle is large, such as when accelerating the vehicle or driving the vehicle uphill, the second signal overrides the first signal in the processing of the microcomputer. Therefore, electromagnetic coil 750 receives the second electric current having an amperage which is of a predetermined magnitude which can generate a sufficient magnetic attraction force so as to attract cylindrical member 752 upwardly against the restoring force of coil springs 774 and 778.

In detail, cylindrical member 752 is moved upwardly against the restoring force of only coil spring 774 until an upper end of small diameter portion 773*b* of rod 773*a* comes in contact with a lower spherical surface of ball valve member 776. Then, cylindrical member 752 is further moved upwardly, pushing ball valve member 776 upwardly through rods 755 and 773*a*, against the restoring force of coil spring 778 in addition to the restoring force of coil spring 774 so that ball valve member 776 is moved away from second valve seat 772*c*.

Therefore, second communication path 700*d* linking discharge chamber 251 to crank chamber 22 is opened by operation of second valve control mechanism 700*b*. That is, the capacity of compressor 10" is quickly minimized by operation of second valve control mechanism 700*b*.

Furthermore, the maximum magnitude of amperage of the first current is appropriately determined so that ball valve member 776 will not be removed from valve seat 772*c* during normal operation of first valve control mechanism 700*a*. Thus, ball valve member blocks second communication path 700*d* during operation of first valve control mechanism 700*a*.

Immediately after second communication path 700*d* is opened, the refrigerant gas in the upper hollow space of small diameter portion 843 of cavity 840, which is maintained at the discharge chamber pressure during compressor operation, quickly flows into crank chamber 22 via hole 777*a*, the upper hollow space of second cylindrical depression 772*b*, holes 775*c*, the lower hollow space of second cylindrical depression 772*b*, hole 772*d*, first cylindrical depression 772*a*, cylindrical cavity 771, holes 770*c*, the upper hollow space of intermediate diameter portion 842 of cylindrical cavity 840 and conduit 157. Thus, the crank pressure is quickly increased to reduce capacity.

However, once second communication path 700*d* has been opened, the refrigerant gas in discharge chamber 251 flows into the upper hollow space of small diameter portion 843 of cavity 840 with a pressure reduction due to the throttling effect of orifice tube 156*a*, and then flows at reduced pressure into crank chamber 22 via hole 777*a*, the upper hollow space of second cylindrical depression 772*b*, holes 775*c*, the lower hollow space of second cylindrical depression 772*b*, hole 772*d*, first cylindrical depression 772*a*, cylindrical cavity 771, holes 770*c*, the upper hollow space of intermediate diameter portion 842 of cylindrical cavity 840 and conduit 157.

Accordingly, though the pressure in crank chamber 22 is quickly increased, it is maintained at a certain value which, relative to the suction pressure, causes slant plate 50 to be positioned in the minimum slant angle. That is, the capacity of the compressor is quickly minimized. However, the crank pressure does not exceed a value which could cause damage to the internal component parts of the compressor.

When the demand for power on the engine of the vehicle to drive the vehicle is large, second communication path 700*d* is opened by virtue of operation of second valve control mechanism 700*b* in order to compulsorily quickly minimize the capacity of the compressor. Therefore, the energy which is derived from the engine to be consumed in operation of the compressor is compulsorily minimized without causing damage of the internal component parts of the compressor. Accordingly, the energy derived from the engine of the vehicle is effectively used for accelerating the vehicle or driving the vehicle uphill, regardless of the demands made on the compressor by the cooling circuit.

This invention has been described in connection with the preferred embodiments. These embodiments, however, are merely for example only and the invention is not restricted thereto. For example, the terms right and left are used merely for convenience of description, and the invention in not restricted in this manner. It will be understood by those skilled in the art that other variations and modifications of this invention can easily be made within the scope of this invention as defined by the claims.

We claim:

1. In a slant plate type compressor including a compressor housing enclosing a crank chamber, a suction chamber and a discharge chamber therein, said compressor housing comprising a cylinder block having a plurality of cylinders, a piston slidably fitted within each of said cylinders, a drive means coupled to said pistons for reciprocating said pistons within said cylinders, said drive means including a drive shaft rotatably supported in said housing, coupling means for drivingly coupling said pistons with said drive shaft and for converting rotary motion of said drive shaft into reciprocating motion of said pistons, said coupling means including a slant plate having a surface disposed at a slant angle relative to a plane perpendicular to said drive shaft, the slant angle changing in response to a change in pressure in said crank chamber relative to said suction pressure to change the capacity of said compressor, a first communication path linking said crank chamber with said suction chamber, a first valve control mechanism disposed within said first communication path, said first valve control mechanism controlling the opening and closing of said first communication path in response to changes in pressure in said suction chamber, a second communication path linking said crank chamber with said discharge chamber, a second valve control mechanism disposed within said second communication path, said second valve control mechanism responding to an external signal and opening said second communication path to increase the pressure in said crank chamber to thereby minimize the capacity of the compressor the improvement comprising:

throttling means disposed within said second communication path between said discharge chamber and said second valve control mechanism so as to regulate the quantity of fluid which flows from said discharge chamber to said crank chamber when said second valve control mechanism opens said second communication path and wherein the first and the second valve control mechanisms operate independently.

2. The compressor recited in claim 1 wherein said first valve control mechanism includes pressure sensing means for sensing pressure in said suction chamber.

3. The compressor recited in claim 2 wherein said pressure sensing means is a diaphragm.

4. The compressor recited in claim 2 wherein said pressure sensing means is a bellows.

5. The compressor recited in claim 1, said first valve control mechanism including a first valve member, said first communication path including a first valve seat formed at one portion thereof, said second valve control mechanism including a second valve member, said second communication path including a second valve seat formed at one portion thereof, said first communication path being opened and closed when said first valve member is moved away from and received on said first valve seat, said second communication path being opened and closed when said second valve member is moved away from and received on said second valve seat, said second valve member moved away from said second valve seat and said first valve member received on said first valve seat when said second valve control mechanism opens said second communication path.

6. The compressor of claim 1, further comprising a cavity disposed in the second communication path between the throttling means and the second valve control mechanism.

7. The compressor of claim 6, wherein the cavity is cylindrical.

8. The compressor of claim 1, further comprising means for storing discharge pressure fluid, disposed in the second communication path between the throttling means and the second valve control mechanism.

9. The compressor of claim 1, further comprising means for reducing the capacity of the compressor, disposed in the second communication path between the throttling means and the second valve control mechanism.

10. The compressor of claim 1, wherein the second valve control mechanism comprises a valve cavity and a valve seat, the valve cavity disposed in the second communication path upstream of the valve seat, and wherein the throttling means is in fluid communication with the valve cavity.

* * * * *